US011227735B2

(12) United States Patent
Uchii et al.

(10) Patent No.: US 11,227,735 B2
(45) Date of Patent: Jan. 18, 2022

(54) GAS CIRCUIT BREAKER

(71) Applicants: KABUSHIKI KAISHA TOSHIBA, Tokyo (JP); Toshiba Energy Systems & Solutions Corporation, Kawasaki (JP)

(72) Inventors: Toshiyuki Uchii, Yokohama Kanagawa (JP); Tomoyuki Yoshino, Yokohama Kanagawa (JP); Takato Ishii, Kawasaki Kanagawa (JP); Akira Shimamura, Yokohama Kanagawa (JP); Tsutomu Tanaka, Yokohama Kanagawa (JP)

(73) Assignees: KABUSHIKI KAISHATOSHIBA, Tokyo (JP); TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 0 days.

(21) Appl. No.: 16/768,734

(22) PCT Filed: Dec. 1, 2017

(86) PCT No.: PCT/JP2017/043343
§ 371 (c)(1),
(2) Date: Jun. 1, 2020

(87) PCT Pub. No.: WO2019/106841
PCT Pub. Date: Jun. 6, 2019

(65) Prior Publication Data
US 2021/0217568 A1 Jul. 15, 2021

(51) Int. Cl.
*H01H 33/42* (2006.01)
*H01H 33/70* (2006.01)

(52) U.S. Cl.
CPC ..... *H01H 33/7023* (2013.01); *H01H 33/42* (2013.01)

(58) Field of Classification Search
CPC ..... H01H 33/56; H01H 33/42; H01H 33/53; H01H 33/55; H01H 33/565; H01H 33/60;
(Continued)

(56) References Cited

U.S. PATENT DOCUMENTS 3,876,846 A * 4/1975 Graybill ..... G01R 31/3272 218/68
3,987,260 A * 10/1976 Wilson ..... H02B 13/075 218/79

(Continued)

FOREIGN PATENT DOCUMENTS

EP 3 125 265 A1 2/2017
JP S61-14444 U 1/1986

(Continued)

*Primary Examiner* — William A Bolton
(74) *Attorney, Agent, or Firm* — Finnegan, Henderson, Farabow, Garrett & Dunner L.L.P.

(57) ABSTRACT

A gas circuit breaker comprises: a first arc contactor 21; a cylindrical second arc contactor 41; a rod-shaped trigger electrode 31 that is disposed to be movable between the first arc contactor 21 and the second arc contactor 41, and moves inside the cylindrical second arc contactor 41 to ignite an arc at the second arc contactor 41 in the latter half of the current break interval; and a guide portion 41*b* that has an inner diameter larger than the outer diameter of the trigger electrode 31, has an inner diameter smaller than the inner diameter of a portion of the second arc contactor 41 which is close to the trigger electrode 31, and is disposed in the cylinder of the second arc contactor 41 so as to go around the trigger electrode 31 when the trigger electrode 31 is in a closed state with the first arc contactor 21.

6 Claims, 6 Drawing Sheets

(58) Field of Classification Search
CPC .. H01H 33/64; H01H 33/7023; H01H 33/703; H01H 33/7038; H01H 33/7046; H01H 33/7053; H01H 33/7069; H01H 33/7084; H01H 33/74; H01H 33/78; H01H 33/904; H01H 33/905; H01H 33/91; H01H 2033/902
USPC ..... 218/50, 51, 57, 59, 61, 63, 68, 79, 80, 218/92, 97, 100, 107, 46, 48
See application file for complete search history.

(56) References Cited

U.S. PATENT DOCUMENTS 4,381,436 A * 4/1983 Nagaoka ..... H01H 33/982 218/61
4,413,166 A * 11/1983 Meyer ..... H02B 13/075 218/80
4,450,329 A * 5/1984 Arimoto ..... H01H 33/7023 218/57
5,929,409 A 7/1999 Zehnder et al.
6,107,590 A * 8/2000 Skindhoj ..... H01H 39/00 218/1
6,163,001 A 12/2000 Zehnder et al.
9,117,608 B2 * 8/2015 Nakada ..... H01H 33/703
2013/0161289 A1 6/2013 Horinouchi et al.
2014/0360984 A1 * 12/2014 Moriyama ..... H01H 33/12 218/146
2015/0194280 A1 7/2015 Uchii et al.
2016/0211097 A1 7/2016 Uchii et al.

FOREIGN PATENT DOCUMENTS

JP H10-31945 A 2/1998
JP H11-329191 A 11/1999
JP 2003-187681 A 7/2003
JP 2012-216894 A 11/2012
JP 2013-215861 A 10/2013
JP 2014-60958 A 4/2014
JP 2014-62590 A 4/2014
JP 2014-72032 A 4/2014
JP 2015-79635 A 4/2015
JP 2015-185381 A 10/2015
JP 2015-185467 A 10/2015

* cited by examiner

[A closed state]

[A first half of a current breaking action]

[A latter half of the current breaking action]

A-A' cross section

B-B' cross section

GAS CIRCUIT BREAKER

FIELD

The present embodiment relates to a gas circuit breaker that breaks a current in a power system.

BACKGROUND

Circuit breaker is used to break current flowing through power supply lines in power system. The gas circuit breaker is arranged in the power supply lines to break current that flows when separating a system in which accident has occurred at the time of system accident.

As the gas circuit breaker described above, a puffer-type gas circuit breaker widely used. The puffer-type gas circuit breaker has a pair of electrodes arranged oppositely in a sealed container filled with arc-extinguishing gas. This pair of electrodes is driven by a driving device arranged outside the gas circuit breaker to open and close.

When the gas circuit breaker is opened to an open-state, this pair of electrodes is driven by the driving device arranged outside the gas circuit breaker, and is mechanically separated. However, since a high voltage is applied in the power system, an arc current continues flowing even after the pair of electrodes is mechanically separated. The puffer-type gas circuit breaker sprays arc-extinguishing gas in the sealed container to an arc, and extinguishes the arc, to break this arc current.

CITATION LIST

Patent Literature

Patent Literature 1: Japanese Patent Laid-Open No. 2014-72032

Patent Literature 2: Japanese Patent Laid-Open No. 2015-79635

Patent Literature 3: Japanese Patent Laid-Open No. 2015-185381

Patent Literature 4: Japanese Patent Laid-Open No. 2015-185467

SUMMARY

The break of current in the gas circuit breaker as described above is performed by moving the moving electrode so as to be separated from the fixed electrode. When breaking current, the moving electrode is moved at a high speed of about 10 m/sec. For this reason, the moving electrode cannot avoid mechanically vibrating during movement, and repeats approaching and separating from other charging parts such as a surrounding insulating material and an arc contactor on the movable side.

Due to mechanical vibration during movement of the moving electrode, the moving electrode and the insulating material are repeatedly approached and separated from each other. This causes a so-called triple junction (triple point) in which the metal, the insulator, and the arc-extinguishing gas come into contact with each other. A triple junction in which the metal, the insulator, and the arc-extinguishing gas contact with each other has an extremely high electric field strength, which may threaten the electric insulation performance of the gas circuit breaker.

It is considered that the approach and separation of the moving electrode and the insulating material due to mechanical vibration during movement of the moving electrode can be reduced by disposing the insulating material away from the moving electrode. However, in order to efficiently extinguish the arc generated between the moving electrode and the fixed electrode, it is desirable to dispose a nozzle made of an insulating material in the vicinity of the moving electrode. The nozzle secures the flow direction and flow velocity of the arc-extinguishing gas sprayed onto the generated arc. Therefore, it is not desirable to dispose the nozzle made of the insulating material away from the moving electrode.

In addition, due to mechanical vibration during movement of the moving electrode, the moving electrode and the arc contactor on the movable side are repeatedly approached and separated from each other. When the moving electrode and the arc contactor on the movable side come into contact with each other, a discharge is generated at the same portion, and the current of the moving electrode is shunted to the arc contactor on the movable side due to the discharge. Due to this discharge, a concave portion due to a discharge mark may be formed on the arc contactor on the movable side. When a concave portion is formed on the arc contactor on the movable side due to the discharge mark, the arc-extinguishing gas leaks from this concave portion and the pressure decreases. As a result, there is a concern that the velocity of the arc-extinguishing gas sprayed to the arc may decrease.

The gas circuit breaker as described above extinguishes the arc by compressing to pressurize the arc extinguishing gas inside with a piston and a cylinder, and spraying this pressurized arc extinguishing gas to the arc. Therefore, it is not desirable that the compressed gas being pressurized during the pressurization of the arc-extinguishing gas leaks to the arc contactor from the concave portion due to the discharge mark, which causes a decrease in the pressure of the arc-extinguishing gas when the pressurization is completed. Because the decrease in pressure of the arc-extinguishing gas that has been pressurized reduces the flow velocity of the arc-extinguishing gas and make it difficult to reliably extinguish the arc. Therefore, it is desirable to reduce the leakage of the arc-extinguishing gas when the arc-extinguishing gas is pressurized.

When a concave portion is formed on the arc contactor on the movable side due to a discharge mark, the arc-extinguishing gas leaks from the concave portion before the arc contactor on the movable side and moving electrode are opened, and then the pressure decreases. As a result, there is a concern that the velocity of the arc-extinguishing gas sprayed to the arc may decrease. Therefore, it is not desirable that a concave portion due to a discharge mark is formed on the arc contactor on the movable side because it may cause a decrease in arc extinguishing performance.

Furthermore, due to mechanical vibration during movement of the moving electrode, the moving electrode and the arc contactor on the movable side may come into contact with each other and slide. When the moving electrode and the arc contactor on the movable side come into contact with each other and slide, the moving electrode and the arc contactor on the movable side are shaved, and fine metal foreign materials (so-called swarf) may be generated. It is not desirable that the electric insulation performance of the gas circuit breaker is deteriorated by the fine metal foreign materials.

An objective of the present embodiment is to provide a gas circuit breaker that can suppresses the mechanical vibration during movement of the moving electrode, reduces the generation of a triple junction during operation of the gas circuit breaker, the decrease in the pressure of the spraying gas due to the arc-extinguishing gas leakage, and the generation of the metal foreign materials, maintains the electrical insulation performance more reliably.

A gas circuit breaker of the present embodiment includes the following structure.

(1) A first arc contactor electrically connected to a first lead-out conductor connected to a power system.

(2) A cylindrical second arc contactor electrically connected to a second lead-out conductor.

(3) A bar-shaped trigger electrode which is arranged to be movable between the first arc contactor and the second arc contactor, which an arc generated between the first arc contactor and the trigger electrode is ignited along with a movement in a first half of a current breaking action, and which moves in the cylindrical second arc contactor 41 during the latter half of the current breaking action to commutates the arc to the second arc contactor.

(4) A guide portion which has an inner diameter larger than an outer diameter of the trigger electrode, and the inner diameter smaller than an inner diameter of a portion of the second arc contactor which is close to the trigger electrode, and which is arranged in a cylinder of the second arc contactor so as to circulate around the trigger electrode when the trigger electrode is in the closed state with the first arc contactor.

DETAILED DESCRIPTION

First Embodiment

1-1. Overall Configuration

Figure 1:
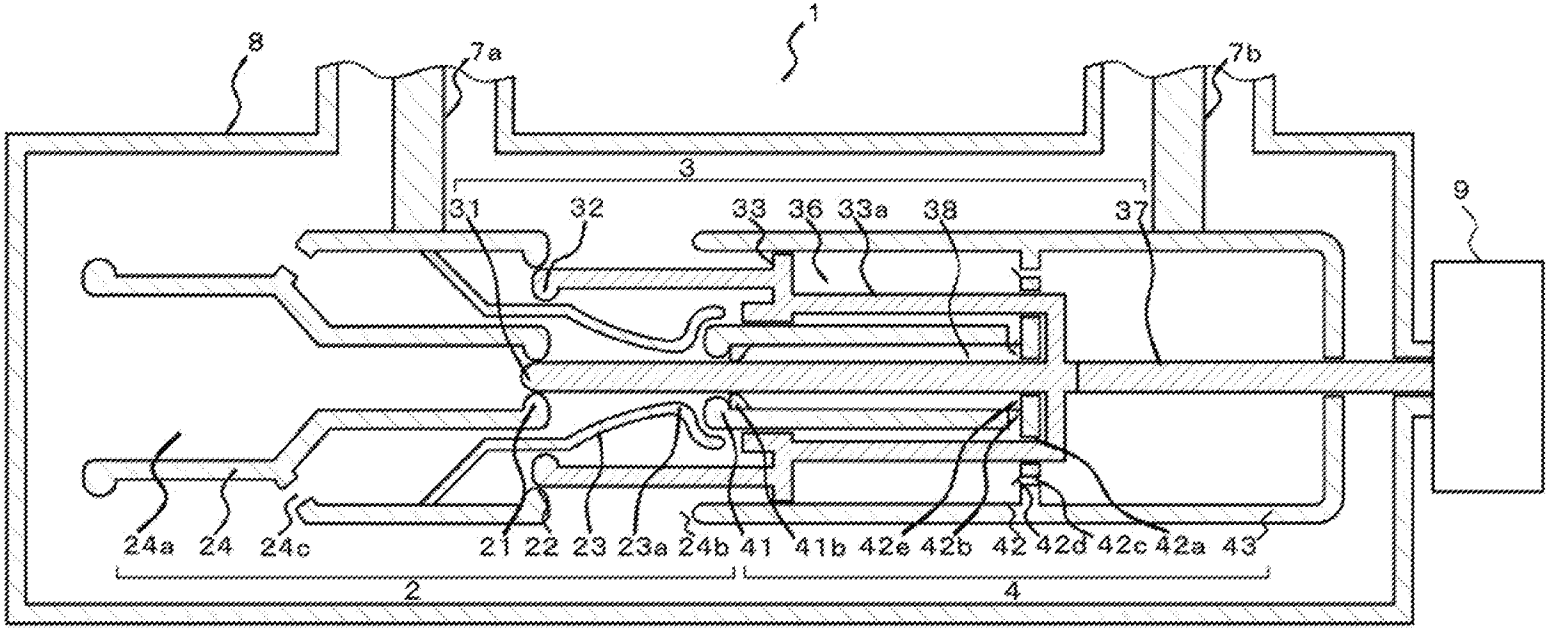
FIG. 1 is a diagram illustrating a closed state of a gas circuit breaker according to a first embodiment.
Figure 2:
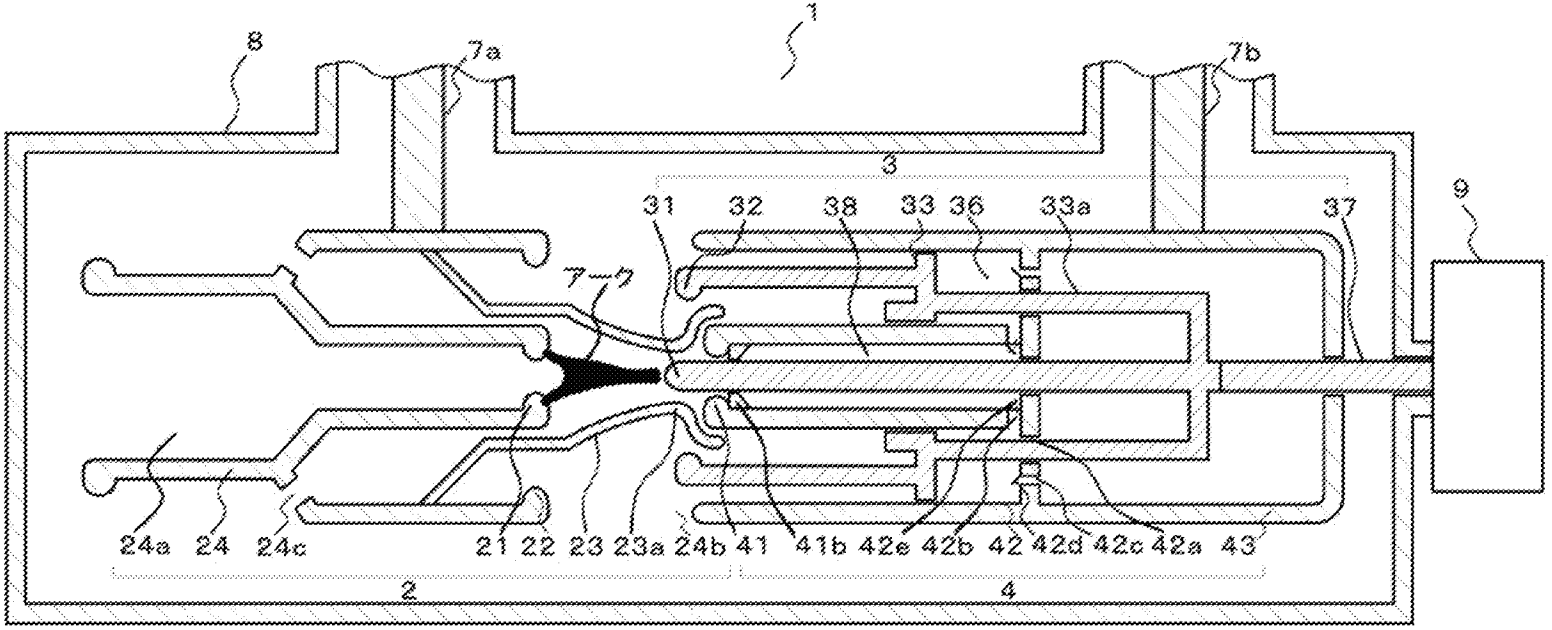
FIG. 2 is a diagram illustrating a first half of a current breaking action of the gas circuit breaker according to the first embodiment.
Figure 3:
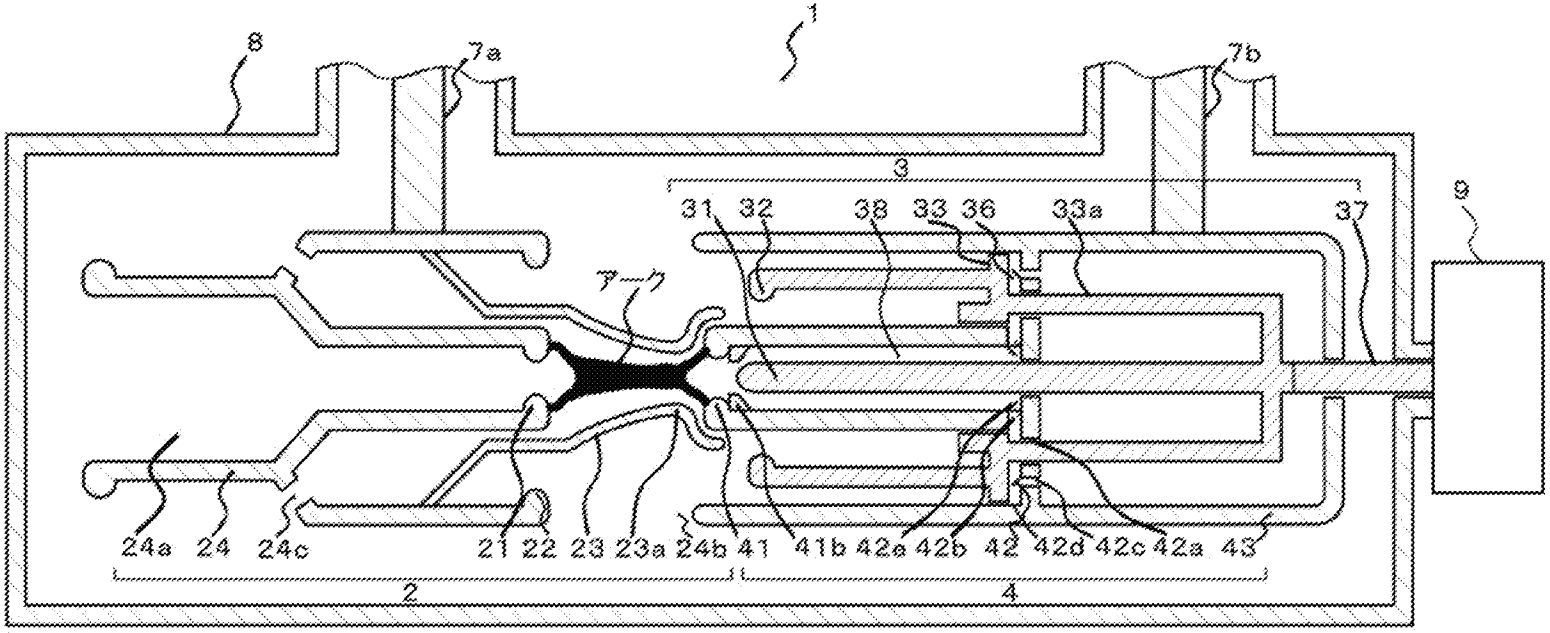
FIG. 3 is a diagram illustrating a latter half of the current breaking action of the gas circuit breaker according to the first embodiment.

Hereinafter, an entire configuration of a gas circuit breaker of the present embodiment will be described with reference to FIGS. 1 to 3. FIG. 1 illustrates an internal structure of the gas circuit breaker 1 in a closed state.

The gas circuit breaker 1 includes a first fixed contactor portion 2 (hereinafter, referred to as a fixed contactor portion 2), a movable contactor portion 3, a second fixed contactor portion 4 (hereinafter referred to as a fixed contactor portion 4), and an sealed container 8. A lead-out conductor 7*a* is connected to the fixed contactor portion 2 via the sealed container 8 and a lead-out conductor 7*b* is connected to the fixed contactor portion 2 and the fixed contactor portion 4 via the sealed container 8. The lead-out conductors 7*a* and 7*b* are connected to a power system. The gas circuit breaker 1 is installed in a power supply facility such as a substation.

The fixed contactor portion 2 and the fixed contactor portion 4 are a cylindrical member made of conductive metal. The movable contactor portion 3 is a cylindrical member made of conductive metal, and is arranged to be in close contact with inner diameter of the fixed contactor portion 2 and the fixed contactor portion 4 and to be slidable. The fixed contactor portion 2 and the fixed contactor portion 4 are fixed and separated by an insulator (not illustrated) in the sealed container 8.

The movable contactor portion 3 is a cylindrical member made of conductive metal. The movable contactor portion 3 is driven by a drive device 9 arranged outside the gas circuit breaker 1, and moves between the fixed contactor portion 2 and the fixed contactor portion 4 to electrically connect or disconnect the fixed contactor portion 2 and the fixed contactor portion 4. Accordingly, the lead-out conductors 7*a* and 7*b* is electrically connected or disconnected.

Note that, although the fixed contactor portion 2 is described as fixed and immovable, a configuration in which the fixed contactor portion 2 is driven relative to the movable contactor portion 3 is also possible. The structure becomes complicated, but an insulation distance between the fixed contactor portion 2 and the movable contactor portion 3 can be quickly increased in an opened state.

When the gas circuit breaker 1 becomes the opened state, an arc is generated between the fixed contactor portion 2 and the movable contactor portion 3. This arc is extinguished by spraying arc-extinguishing gas filled in the sealed container 8 with a high pressure.

The sealed container 8 is a cylindrical sealed container made of metal, glass, etc., and the arc-extinguishing gas is filled therein. As the arc-extinguishing gas, sulfur hexafluoride gas (SF6 gas) with excellent arc extinguishing performance and insulation performance is used. When being made of metal, the sealed container 8 is connected to a ground potential. A pressure inside the sealed container 8 is a single pressure, for example a filling pressure of the arc-extinguishing gas, at any portion of the sealed container 8 in the normal operation.

The arc-extinguishing gas is electrical insulation gas for extinguishing the arc. Currently, SF6 gas is used as the arc-extinguishing gas in many cases. However, SF6 gas has high global warming effect. Accordingly, instead of SF6 gas, other gas may be used as the arc-extinguishing gas. It is preferable that arc-extinguishing gas serving as substitute for SF6 gas has excellent insulation performance, arc cooling performance (arc extinguishing performance), chemical stability, environmental compatibility, and availability, cost, etc. According to the present embodiment illustrated in FIGS. 1 to 3, since the gas to be sprayed is pressurized by adiabatic compression, it is preferable that the arc-extinguishing gas serving as a substitute for SF6 gas is gas having a high heat capacity ratio which the pressure of the gas tends to increase at the same cylinder capacity and compression ratio.

The driving device 9 is a device for driving the movable contactor portion 3 to open and close the gas circuit breaker 1. The driving device 9 has a power source therein, and as the power source, a spring, a hydraulic pressure, high-pressure gas, or an electric motor, etc., is applied. The movable contactor portion 3 is moved between the fixed contactor portion 2 and fixed contactor portion 4 by the driving device 9, so that the fixed contactor portion 2 and the fixed contactor portion 4 are electrically disconnected from or connected to each other.

The driving device 9 is operated based on a command signal transmitted from the outside to open and close the gas circuit breaker 1. The driving device 9 is required to stably store large drive energy, to have extremely quick responsiveness to the command signal, and to perform a more reliable operation. The driving device 9 is not required to be placed in the arc-extinguishing gas.

When the gas circuit breaker 1 is in the opened state, it is preferable that a position of a piston 33 of the movable contactor portion 3 is held so that the piston 33 does not move reversely, until the arc-extinguishing gas pressurized in a compression chamber 36 to be described later is discharged to an arc space between an arc contactor (on a fixed side) 21 and an arc contactor (on a movable side) 41 through an accumulation chamber 38 to be described later, and the pressure inside the compression chamber 36 falls sufficiently. When the piston 33 moves reversely, a volume of the compression chamber 36 increases, the pressures of the compression chamber 36 and the accumulation chamber 38 decrease. This is not preferable because a spraying pressure applied to the arc decreases. A reverse movement prevention structure may be provided in the driving device 9 to prevent this reverse movement.

The fixed contactor portion 2 is a cylindrical member that is arranged in the sealed container 8. The fixed contactor portion 2 includes the arc contactor (on a fixed side) 21, a fixed conductive contactor 22, an insulation nozzle 23, and an exhaust pipe 24. The arc contactor (on the fixed side) 21 corresponds to a first arc contactor in the claims. Details of these members will be described later. The lead-out conductor 7*a* is connected to the fixed contactor portion 2 via the sealed container 8. The fixed contactor portion 2 is fixed and arranged to the sealed container 8. When the gas circuit breaker 1 is in the closed state, the fixed contactor portion 2 is electrically connected to the fixed contactor portion 4 via the movable contactor portion 3, and the current flows between the lead-out conductors 7*a* and 7*b*. On the other hand, when the gas circuit breaker 1 is in the opened state, the fixed contactor portion 2 is electrically disconnected from the movable contactor portion 3, and the current between the lead-out conductors 7*a* and 7*b* is broken.

The fixed contactor portion 4 is a cylindrical member that is arranged in the sealed container 8. The fixed contactor portion 4 includes the arc contactor (on the movable side) 41, the cylinder 42, and the support 43. The arc contactor (on the movable side) 41 corresponds to a second arc contactor in the claims. Note that the arc contactor (on the movable side) 41 itself is not movable. Details of these members will be described later. The lead-out conductor 7*b* is connected to the fixed contactor portion 4 via the sealed container 8. The fixed contactor portion 4 is fixed and arranged to the sealed container 8.

When the gas circuit breaker 1 is in the closed state, the fixed contactor portion 4 is electrically connected to the fixed contactor portion 2 via the movable contactor portion 3, and the current flows between the lead-out conductors 7*a* and 7*b*. On the other hand, when the gas circuit breaker 1 is in the opened state, the fixed contactor portion 4 is electrically disconnected from the fixed contactor portion 2 and the movable contactor portion 3, and the current between the lead-out conductors 7*a* and 7*b* is broken.

The movable contactor portion 3 is a cylindrical member arranged in the sealed container 8. The movable contactor portion 3 includes a trigger electrode 31, a movable conductive contactor 32, a piston 33, a piston support 33*a*, and an insulation rod 37. Details of these members will be described later. The movable contactor portion 3 is arranged to be reciprocally movable between the fixed contactor portion 2 and the fixed contactor portion 4.

The movable contactor portion 3 is mechanically connected to the driving device 9 arranged outside the gas circuit breaker 1. The movable contactor portion 3 is driven by the driving device 9 to open and close the gas circuit breaker 1, breaking and conducting the current flowing through the lead-out conductors 7*a* and 7*b*. When the gas circuit breaker 1 is in the closed state, the movable contactor portion 3 is electrically connected with the fixed contactor portion 2 and the fixed contactor portion 4, and the current flows between the lead-out conductors 7*a* and 7*b*. On the other hand, when the gas circuit breaker 1 is in the opened state, the movable contactor portion 3 is electrically disconnected from the fixed contactor portion 2, and the current between the lead-out conductors 7*a* and 7*b* is broken.

In addition, the movable contactor portion 3 compresses the arc-extinguishing gas accumulated in the cylinder 42 by the piston 33, and makes the arc-extinguishing gas to blowout from the insulation nozzle 23, the arc generated between the fixed contactor portion 2 and the movable contactor portion 3 is extinguished to break the arc current.

The fixed contactor portion 2, the movable contactor portion 3, the fixed contactor portion 4, and the sealed container 8 are concentric cylindrical members having a common center axis, and are arranged on the same axis. In below, to describe positional relation and direction of each member, a direction toward the fixed contactor portion 2 side is called an open-end direction, and a direction toward the fixed contactor portion 4 side opposite thereto is called driving-device direction.

1-2. Detailed Configuration (Fixed Contactor Portion 2)

The fixed contactor portion 2 includes the arc contactor (on the fixed side) 21, the fixed conductive contactor 22, the insulation nozzle 23, and the exhaust pipe 24. The arc contactor (on the fixed side) 21 corresponds to the first arc contactor in the claims. Furthermore, the arc contactor (on the fixed side) 21 may be also referred to herein as the first arc contactor.

(Fixed Conductive Contactor 22)

The fixed conductive contactor 22 is a ring-shape electrode arranged on an end surface of the fixed contactor portion 2 on an outer circumference portion in the driving-device direction. The fixed conductive contactor 22 is formed of a metal conductor formed into a ring shape bulging toward the inner diameter side by shaving, etc. The metal forming the fixed conductive contactor 22 is preferably aluminum in view of electric conductivity, lightweight property, strength, and workability, but otherwise, may be, for example, copper.

The fixed conductive contactor 22 has the inner diameter which is slidable and which has a constant clearance, relative to the outer diameter of the movable conductive contactor 32 of the movable contactor portion 3. The fixed conductive contactor 22 is arranged at an end of the exhaust pipe 24, which is formed of cylindrical conductive metal, in the driving-device direction. The exhaust pipe 24 is connected to the lead-out conductor 7*a* via the sealed container 8. The exhaust pipe 24 is fixed to the sealed container by an insulation member.

When the gas circuit breaker 1 is in the closed state, the movable conductive contactor 32 of the movable contactor portion 3 is inserted into the fixed conductive contactor 22. Accordingly, the fixed conductive contactor 22 contacts with the movable conductive contactor 32, and the fixed contactor portion 2 and the movable contactor portion 3 are electrically connected to each other. When power is applied, a rated current flows through the fixed conductive contactor 22.

On the other hand, when the circuit breaker 1 is in the opened state, the fixed conductive contactor 22 is physically separated from the movable conductive contactor 32 of the movable contactor portion 3, and the fixed contactor portion 2 and the movable contactor portion 3 are electrically disconnected from each other.

(Arc Contactor (on a Fixed Side) 21)

The arc contactor (on the fixed side) 21 is a cylindrical electrode arranged on an end of the fixed contactor portion 2 on the driving-device direction along the center axis of the cylinder of the fixed contactor portion 2. The arc contactor (on the fixed side) 21 is formed of a metal conductor which is formed into a cylindrical shape having a diameter smaller than that of the fixed conductive contactor 22 and which the end on the driving-device direction has a rounded shape. The arc contactor (on the fixed side) 21 is made of metal containing 10% to 40% of copper and 90% to 60% of tungsten, etc.

When the gas circuit breaker 1 is in the closed state, the arc contactor (on the fixed side) 21 contacts with an outer diameter portion of the trigger electrode 31 of the movable contactor portion 3. The arc contactor (on the fixed side) 21 is integrally fixed to the fixed contactor portion 2 by a support member provided on an inner wall surface of the exhaust pipe 24 forming an outer circumference of the fixed contactor portion 2. The arc contactor (on the fixed side) 21 is arranged in the arc-extinguishing gas, and ignites an arc generated in the arc-extinguishing gas.

The arc contactor (on the fixed side) 21 is fixed, and does not contribute to a weight of a movable component which the driving device 9 should drive. Accordingly, a large heat capacity and a large surface area can be achieved, improving the durability of the arc contactor (on the fixed side) 21.

It is preferable that the durability of the arc contactor (on the fixed side) 21, the durability of the arc contactor (on the movable side) 41, and the durability of the trigger electrode 31 have the following relation.

The durability of the arc contactor (on the fixed side) the durability of the arc contactor (on the movable side) 41≥the durability of the trigger electrode 31

This is because the arc contactor (on the fixed side) 21 is more likely to wear compared to the arc contactor (on the movable side) 41 for the arc-extinguishing gas flow that has become a high temperature is accelerated and thereafter collides with the arc contactor 21. In addition, this is because while it is preferable that the trigger electrode 31 that is a movable component is made more lightweight than he arc contactor (on the fixed side) 21 and the arc contactor (on the movable side) 41, a wear level of the trigger electrode 31 is small compared to that on the arc contactor (on the fixed side) 21 and that on the arc contactor (on the movable side) 41 for the high-temperature arc is ignited only for a certain period of time until the arc is commutated to the arc contactor (on the movable side) 41, as described below.

The arc contactor (on the fixed side) 21 is arranged to be separated from the arc contactor (on the movable side) 41 at a distance which the insulation can be ensured after the arc is extinguished. Since the arc contactor (on the fixed side) 21 and the arc contactor (on the movable side) 41 are fixed and are not movable, the arc contactor (on the fixed side) 21 and the arc contactor (on the movable side) 41 can be large in size. Therefore, the electric field in the space between the arc contactor (on the fixed side) 21 and the arc contactor (on the movable side) 41 has more uniform distribution (distribution with a lower concentration of the electric field) compared to the conventional technique, and the distance between the arc contactor (on the fixed side) 21 and the arc contactor (on the movable side) 41 can be made shorter than the conventional technique.

Furthermore, the flow rate and the flow velocity of the arc-extinguishing gas to be sprayed to the arc can be defined based on a distance between the insulation nozzle 23 and the arc contactor (on the fixed side) 21 and a distance between the insulation nozzle 23 and the arc contactor (on the movable side) 41. It is preferable that the distance between the arc contactor (on the fixed side) 21 and the insulation nozzle 23 is larger than the distance between the arc contactor (on the movable side) 41 and the insulation nozzle 23, because the arc-extinguishing gas sprayed to the arc can be easily and quickly exhausted in the open-end direction.

When the gas circuit breaker 1 is in the closed state, the trigger electrode 31 of the movable contactor portion 3 is inserted into the arc contactor (on the fixed side) 21. Accordingly, the arc contactor (on the fixed side) 21 contacts the trigger electrode 31 of the movable contactor portion 3, and the fixed contactor portion 2 and the movable contactor portion 3 are electrically connected to each other. When the gas circuit breaker 1 is in the closed state, the arc contactor (on the fixed side) 21 serves as a conductor forming a part of a current circuit, so that the lead-out conductors 7*a* and 7*b* are electrically connected to each other.

On the other hand, when the gas circuit breaker 1 is in the opened state, the arc contactor (on the fixed side) 21 is separated from the trigger electrode 31 of the movable contactor portion 3, and ignites an arc generated between the fixed contactor portion 2 and the movable contactor portion 3. The arc contactor (on the fixed side) 21 forms a pair of electrodes that are arranged to face the trigger electrode 31, and serves as one of electrodes that contact the arc when the gas circuit breaker 1 becomes the opened state. Since the fixed conductive contactor 22 and the movable conductive contactor 32 of the movable contactor portion 3 are separated from each other before the arc contactor (on the fixed side) 21 and the trigger electrode 31 are separated from each other and after the current is commutated to the arc contactor (on the fixed side) 21 side and the trigger electrode 31 side, the arc is not generated between the fixed conductive contactor 22 and the movable conductive contactor 32 of the movable contactor portion 3.

Since the arc contactor (on the fixed side) 21 and the trigger electrode 31 are separated from each other after the fixed conductive contactor 22 and the movable conductive contactor 32 are separated from each other, the arc is always ignited between the arc contactor (on the fixed side) 21 and the trigger electrode 31. This reduces the degradation of the fixed conductive contactor 22 and the movable conductive contactor 32 due to the arc.

When the gas circuit breaker 1 becomes the opened state, the movable contactor portion 3 is driven by the driving device 9, and moves between the arc contactor (on the fixed side) 21 and the arc contactor (on the movable side) 41 from the open-end direction side to the driving-device direction side. Accordingly, the trigger electrode 31 also moves between the arc contactor (on the fixed side) 21 and the arc contactor (on the movable side) 41 from the open-end direction side to the driving-device direction side. The fixed conductive contactor 22 and the movable conductive contactor 32 are separated from each other before the trigger electrode 31 is separated from the arc contactor (on the fixed side) 21. This is not to cause the arc to be generated between the fixed conductive contactor 22 and the movable conductive contactor 32.

The arc is generated between the trigger electrode 31 and the arc contactor (on the fixed side) 21 from a time point when the trigger electrode 31 starts to be separated from the arc contactor (on the fixed side) 21 until the separation distance between the arc contactor (on the fixed side) 21 and the arc contactor (on the movable side) 41 becomes equal to the separation distance between the arc contactor (on the fixed side) 21 and the trigger electrode 31.

When the separation distance between the arc contactor (on the fixed side) 21 and the arc contactor (on the movable side) 41 becomes almost equal to the separation distance between the arc contactor (on the fixed side) 21 and the trigger electrode 31, the arc is transferred from the trigger electrode 31 to the arc contactor (on the movable side) 41. The arc is generated between the arc contactor (on the movable side) 41 and the arc contactor (on the fixed side) 21 from a time point when the separation distance between the arc contactor (on the fixed side) 21 and the arc contactor (on the movable side) 41 becomes approximately equal to the separation distance between the arc contactor (on the fixed side) 21 and the trigger electrode 31 until the arc is extinguished. At this time, the arc contactor (on the movable side) 41 and the arc contactor (on the fixed side) 21 form a pair of electrodes that are arranged to face each other, and ignite the arc.

The period of time from a time point when the trigger electrode 31 starts to be separated from the arc contactor (on the fixed side) 21 until the separation distance between the arc contactor (on the fixed side) 21 and the arc contactor (on the movable side) 41 becomes equal to the separation distance between the arc contactor (on the fixed side) 21 and the trigger electrode 31 may be referred to as a "first half of a current breaking action."

The period of time from a time point when the separation distance between the arc contactor (on the fixed side) 21 and the arc contactor (on the movable side) 41 becomes equal to the separation distance between the arc contactor (on the fixed side) 21 and the trigger electrode 31 until the arc is extinguished may be referred to as a "latter half of the current breaking action."

The trigger electrode 31 moves further in the driving-device direction, that is, in a direction in which the separation distance between the arc contactor (on the fixed side) 21 and the trigger electrode 31 becomes larger than the separation distance between the arc contactor (on the fixed side) 21 and the arc contactor (on the movable side) 41. This causes the trigger electrode 31 to be separated from the arc generated between the arc contactor (on the movable side) 41 and the arc contactor (on the fixed side) 21, reducing the degradation of the trigger electrode 31.

The trigger electrode 31 moves further in the driving-device direction. Then, a sealed state on the open-end direction side of the accumulation chamber 38 formed by the trigger electrode 31 and the arc contactor (on the movable side) 41 is opened. Thus, the arc-extinguishing gas pressurized in the compression chamber 36 that is formed by the piston 33 and the cylinder 42 is sprayed via the accumulating chamber 38 formed by the trigger electrode 31 and the arc contactor (on the movable side) 41 and via the insulation nozzle 23, and the arc between the arc contactor (on the fixed side) 21 and the arc contactor (on the movable side) 41 is extinguished.

Note that a tip of the arc contactor (on the fixed side) 21 may be divided in a circumference direction to be a finger-like electrode. In this case, the arc contactor (on the fixed side) 21 is flexible, and the inner diameter of an opening edge of the arc contactor (on the fixed side) 21 is slightly smaller than the outer diameter of the trigger electrode 31 and is narrowed. When the trigger electrode 31 is inserted into an opening of the arc contactor (on the fixed side) 21, the arc contactor (on the fixed side) 21 and the trigger electrode 31 contact each other, and are connected.

(Insulation Nozzle 23)

The insulation nozzle 23 is a cylindrical rectifying member having a throat portion 23*a* that defines a flow velocity balance of the arc-extinguishing gas pressurized in the compression chamber 36. The insulation nozzle 23 is a heat-resistant insulator such as polytetrafluoroethylene (PTFE) resin.

The insulation nozzle 23 is integrally fixed to the fixed contactor portion 2, and is arranged so that an axis of the cylinder of the insulation nozzle 23 is located on the cylindrical axis of the arc contactor (on the fixed side) 21.

The insulation nozzle 23 is arranged to surround the trigger electrode 31 when the gas circuit breaker 1 is in the closed state. The insulation nozzle 23 has a shape such that an interior thereof forms a conical space from the open-end direction side toward the driving-device direction side. The insulation nozzle 23 extends along the axis from the arc contactor (on the fixed side) 21 to the arc contactor (on the movable side) 41 side, and has the throat portion 23*a* which has a minimum diameter at between the arc contactor (on the fixed side) 21 and the arc contactor (on the movable side) 41.

The arc-extinguishing gas pressurized in the compression chamber 36 is guided to the arc space by the insulation nozzle 23. In addition, the arc-extinguishing gas is concentrated in the arc space by the throat portion 23*a* of the insulation nozzle 23, and the flow velocity of the arc-extinguishing gas is increased in the flow passage expanding from the throat portion 23*a*.

When the gas circuit breaker 1 becomes the opened state, the arc-extinguishing gas in the compression chamber 36 formed by the piston 33 of the movable contactor portion 3 and the cylinder 42 of the fixed contactor portion 4 is pressurized. The arc contactor (on the movable side) 41 and the trigger electrode 31 form the accumulation chamber 38 of this pressurized arc-extinguishing gas. In the stage in which the arc-extinguishing gas in the compression chamber 36 is pressurized by the piston 33 and the cylinder 42, the trigger electrode 31 is being inserted into the arc contactor (on the movable side) 41, and the accumulation chamber 38 is in the sealed state.

In an end stage of the pressurization process of the arc-extinguishing gas in the compression chamber 36, the arc contactor (on the movable side) 41 and the trigger electrode 31 are separated from each other, and the arc-extinguishing gas which is pressurized in the compression chamber 36 and is stored in the accumulation chamber 38 is sprayed to the arc space between the arc contactor (on the fixed side) 21 and the arc contactor (on the movable side) 41. At this time, the pressurized arc-extinguishing gas is concentrated in the arc space by the insulation nozzle 23. Accordingly, the arc between the arc contactor (on the movable side) 41 and the arc contactor (on the fixed side) 21 is efficiently extinguished, and the arc contactor (on the movable side) 41 and the arc contactor (on the fixed side) 21 are electrically disconnected from each other.

The arc-extinguishing gas that has been sprayed to the arc space between the arc contactor (on the fixed side) 21 and the arc contactor (on the movable side) 41 and become a high temperature is cooled by passing through the exhaust cylinder 24 of the fixed contactor portion 2, recovers the insulation performance, and is exhausted into the sealed container 8.

Thermal energy generated by the arc discharge is removed by the arc-extinguishing gas. As a result, the arc-extinguishing gas gains the thermal energy generated by the arc discharge, and becomes high temperature and high pressure. The arc-extinguishing gas that has become a high temperature and a high pressure is discharged from exhaust ports 24*a*, 24*b* and 24*c* of the exhaust cylinder 24, so that the thermal energy is eliminated from electrode regions.

The insulation nozzle 23 concentratedly guides the arc-extinguishing gas pressurized by the throat portion 23*a* to the arc space. Furthermore, the insulation nozzle 23 accelerates the arc-extinguishing gas in an expanded portion from the throat portion 23*a*, and improves the discharging performance of the thermal energy. In addition, the insulation nozzle 23 defines the exhaust passage of the arc-extinguishing gas heated to a high temperature by the arc, and for example, suppresses dielectric breakdown between the fixed conductive contactor 22 and the movable conductive contactor 32. Furthermore, the insulation nozzle 23 suppresses expansion of the arc by using the throat portion 23*a*, and defines the minimum diameter of the arc at the throat portion 23*a*. The insulation nozzle 23 appropriately controls the flow rate and the flow velocity of the arc-extinguishing gas by using the throat portion 23*a*. Therefore, the arc-extinguishing gas is efficiently sprayed to the arc generated between the arc contactor (on the movable side) 41 and the arc contactor (on the fixed side) 21, the thermal energy is efficiently removed, and the arc is extinguished. As a result, the arc contactor (on the movable side) 41 and the arc contactor (on the fixed side) 21 are electrically disconnected from each other.

In the conventional technique, there are many cases where the insulation nozzle 23 is provided in the movable contactor portion 3 together with the movable conductive contactor 32. However, it is preferable that the movable contactor portion 3 is reduced in weight to be movable. Accordingly, it is preferable that the insulation nozzle 23 is provided in the fixed contactor portion 2 that does not move. Note that the insulation nozzle 23 may be provided in the movable contactor portion 3.

The insulation nozzle 23 may be provided in either the fixed contactor portion 2 or the movable contactor portion 3, but the movable contactor portion 3 vibrates due to the movement. Accordingly, electrical performance deterioration due to the vibration can be more suppressed in the case where the insulation nozzle 23 is provided in the fixed contactor portion 2 compared with the case where the insulation nozzle 23 is provided in the movable contactor portion 3.

Since the insulation nozzle 23 can suppress the flow of the arc-extinguishing gas with low insulation performance and a high temperature into the fixed conductive contactor 22, it is preferable that the insulation nozzle 23 is provided in the fixed contactor portion 2. It is preferable that a clearance distance between the insulation nozzle 23 and the trigger electrode 31 is larger than the clearance distance between the arc contactor (on the movable side) 41 and the trigger electrode 31 during contact therebetween. When the insulation nozzle 23 and the trigger electrode 31 contacts with each other, a high electric field portion is created and considerable degradation of the electrical performance occurs. With the configuration described above, the maximum positional displacement width of the trigger electrode 31 from the center axis can be restricted by the inner diameter of the arc contactor (on the movable side) 41, preventing contact between the trigger electrode 31 and the insulation nozzle 23. In addition, an amount of leakage of the arc-extinguishing gas from the accumulation chamber 38 can be suppressed by limiting the clearance distance between the arc contactor (on the movable side) 41 and the trigger electrode 31.

When spraying the arc-extinguishing gas to the arc generated between the arc contactor (on the movable side) 41 and the arc contactor (on the fixed side) 21, it is preferable that the insulation nozzle 23 has a lower internal pressure. Accordingly, it is preferable that the insulation nozzle 23 has a shape such that a cross-sectional area of the arc-extinguishing gas flow passage formed by the arc contactor (on the fixed side) 21 and the insulation nozzle 23 increases toward the open-end direction.

According to the test results, in order to obtain good breaking performance, it is preferable to have the following flow passage configuration.

Area of the flow passage formed between the arc contactor (on the fixed side) 21 and the insulation nozzle 23>Area of the flow passage of the throat portion 23*a* of the insulation nozzle 23>Area of the spray portion of the arc contactor (on the movable side) 41

The insulation nozzle 23 controls the flow of the arc-extinguishing gas sprayed via the compression chamber 36 and the accumulation chamber 38 to efficiently cool the arc. Since the pressure inside the insulation nozzle 23 becomes a downstream pressure when the arc-extinguishing gas is sprayed, it is preferable to provide a structure such that the insulation nozzle 23 is always maintained at a low pressure.

The insulation nozzle 23 not only creates the arc-extinguishing gas flow parallel to the axis from the driving-device direction side to the open-end direction side, but also creates the arc-extinguishing gas flow in a direction crossing the arc. The arc is efficiently cooled by this flow. Since the arc-extinguishing gas that has become a high temperature by being sprayed to the arc has low insulation performance, it is preferable that the arc-extinguishing gas is exhausted without contacting the fixed conductive contactor 22 and the movable conductive contactor 32.

(Exhaust Pipe 24)

The exhaust pipe 24 is a cylindrical member made of conductive metal formed by shaving. The arc contactor (on the fixed side) 21 and the fixed conductive contactor 22 are arranged at the end of the exhaust pipe 24 on the driving-device direction side, so that the axes thereof are aligned with the axis of the exhaust pipe 24. The exhaust pipe 24 has the exhaust ports 24*a*, 24*b*, and 24*c* for exhausting the arc-extinguishing gas that has become a high temperature. The exhaust pipe 24 may be formed integrally with the arc contactor (on the fixed side) 21 and the fixed conductive contactor 22.

The exhaust pipe 24 is connected to the lead-out conductor 7*a* via the sealed container 8. The exhaust pipe 24 is an arc-extinguishing gas flow passage, and guides the arc-extinguishing gas which has been sprayed to the arc and has become a high temperature from the arc space between the arc contactor (on the fixed side) 21 and the trigger electrode 31 to the sealed container 8.

When the gas circuit breaker 1 becomes the opened state, the arc-extinguishing gas in the compression chamber 36 formed by the piston 33 of the movable contactor portion 3 and the cylinder 42 of the fixed contactor portion 4 is pressurized, and is sprayed to the arc space between the arc contactor (on the fixed side) 21 and the arc contactor (on the movable side) 41. The arc-extinguishing gas that has been sprayed to the arc and become a high temperature is finally exhausted into the sealed container 8 through the exhaust ports 24*a*, 24*b*, and 24*c* of the exhaust cylinder 24.

(Fixed Contactor Portion 4)

The fixed contactor portion 4 includes the arc contactor (on the movable side) 41, the cylinder 42, and the support 43. The arc contactor (on the movable side) 41 corresponds to the second arc contactor in the claims. Furthermore, the arc contactor (on the movable side) 41 may be also referred to herein as the second arc contactor.

(Arc Contactor (on a Movable Side) 41)

The arc contactor (on the movable side) 41 is a cylindrical electrode that is arranged on an end of the fixed contactor portion 4 on the open-end direction side along the center axis of the cylinder of the fixed contactor portion 4. The arc contactor (on the movable side) 41 includes a conductive portion 41*a* and a guide portion 41*b*. The conductive portion 41*a* of the arc contactor (on the movable side) 41 is formed of a metal conductor which is formed into a cylindrical shape having a diameter substantially equal to that of the fixed conductive contactor 22 and which the end on the open-end direction side has a rounded shape. The conductive portion 41*a* of the arc contactor (on the movable side) 41 is made of metal containing 10% to 40% of copper and 90% to 60% of tungsten, etc.

Figure 4:
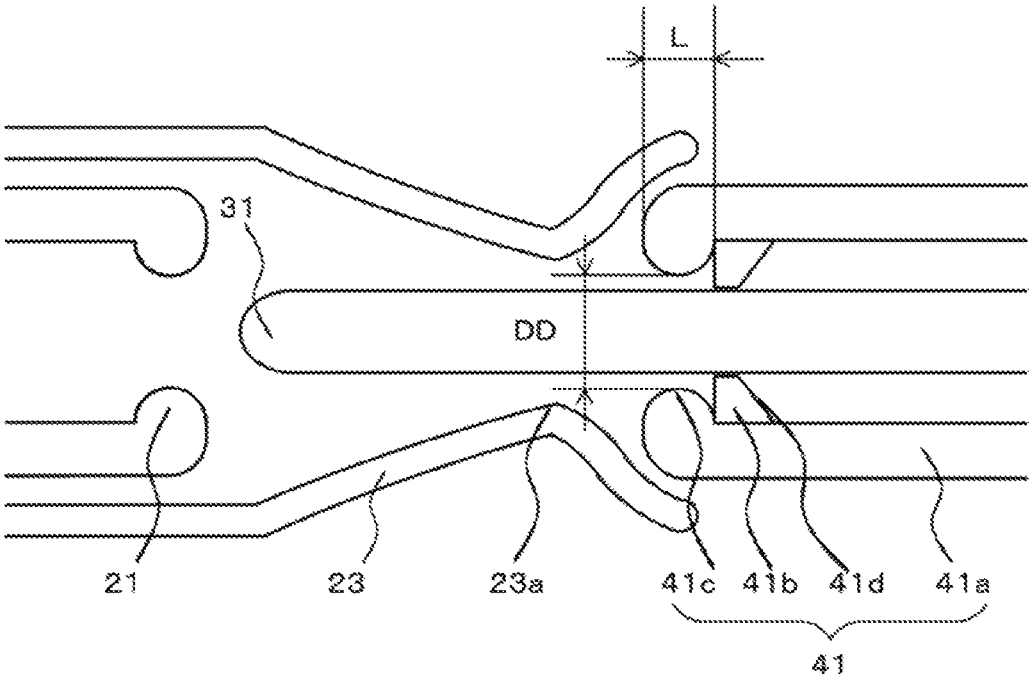
FIG. 4 is an enlarged view illustrating a positional relation between the arc contoctor (on the movable side) and the guide portion against the trigger electrode of the gas circuit breaker according to the first embodiment.

As shown in FIG. 4, the guide portion 41*b* is arranged in the open-end direction in the cylinder of the conductive portion 41*a* of the arc contactor (on the movable side) 41. The guide portion 41*b* has an inner diameter larger than an outer diameter of the trigger electrode 31, and smaller than an inner diameter of the contact end 41*c* portion of the conductive portion 41*a* which is close to the trigger electrode 31. The guide portion 41*b* is arranged in the cylinder of the conductive portion 41*a* of the arc contactor (on the movable side) 41 so as to circulate around the trigger electrode 31 when the trigger electrode 31 is in the closed state with the arc contactor (on the fixed side) 21.

Further, the guide portion 41*b* is arranged in the cylinder of the conductive portion 41*a* of the arc contactor (on the movable side) 41 so as to be separated from an end in the open-end direction (arc-contactor-(on the fixed side)-21 side) of the arc contactor (on the movable side) 41 to the opposite side of the arc contactor (on the movable side) 41, by at least the distance obtained by multiplying the inner diameter of the contact end 41*c* by 0.2. The contact end 41*c* is a portion of the conductive portion 41*a* of the arc contactor (on the movable side) 41 that is close to the trigger electrode 31.

The inner diameter of the guide portion 41*b* has a taper portion 41*d* that increases toward the drive device direction, and forms a truncated cone-shaped space inside the arc contactor (on the movable side) 41.

The guide portion 41*b* is made of at least one of insulating materials among acrylic, polycarbonate, polystyrene, polyethylene, polypropylene, polyolefin, and PTFE.

The guide portion 41*b* suppresses the mechanical vibration due to movement of the trigger electrode 31 during the current breaking action, and prevents the trigger electrode 31 from contacting, sliding, or approaching and separating from the insulation nozzle 23 made of an insulating material and the contact end 41*c* of the arc contactor (on the movable side) 41 made of a metallic material. The guide portion 41*b* reduces the generation of the triple junction and the generation of metallic foreign materials.

Figure 5:
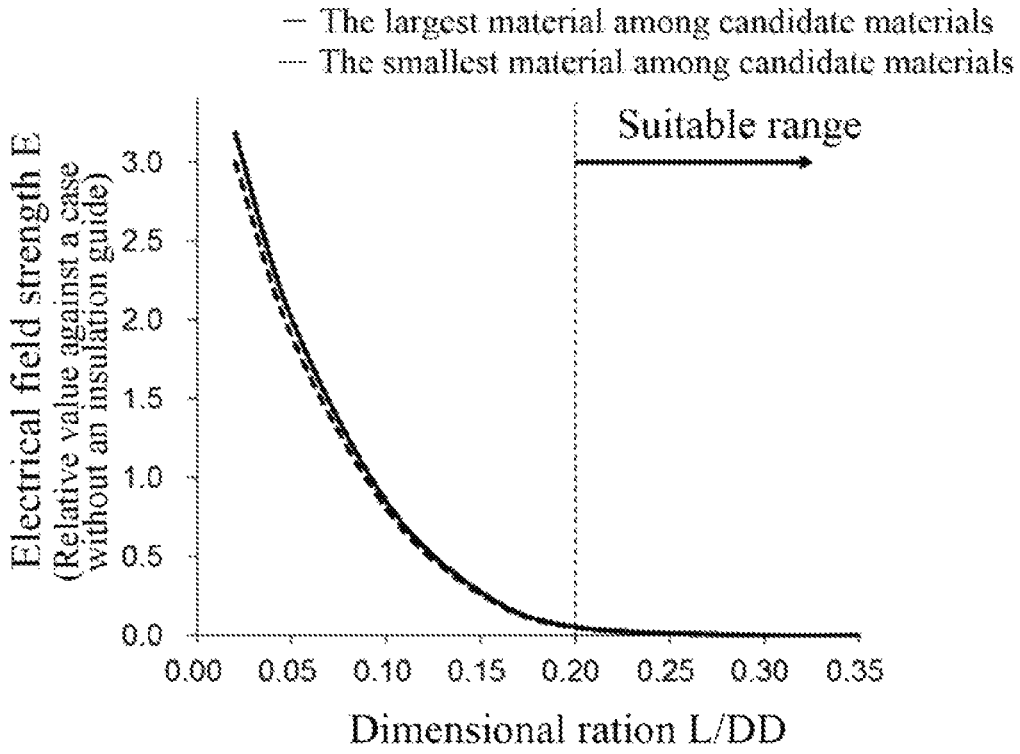
FIG. 5 is a graph illustrating a relation between electrical field strength and arranging position of the guide portion against the arc contoctor (on the movable side) according to the first embodiment.

Further, the guide portion 41*b* is arranged in the cylinder of the conductive portion 41*a* of the arc contactor (on the movable side) 41 so as to be separated from an end in the open-end direction (arc-contactor-(on the fixed side)-21 side) of the arc contactor (on the movable side) 41 by at least the distance L obtained by multiplying the inner diameter DD of the contact end 41*c* of the arc contactor (on a movable side) 41 by 0.2. As a result, as shown in FIG. 5, the electric field strength at the contact portion of the guide portion 41*b* and the trigger electrode 31 is reduced.

Therefore, the triple junction due to the guide portion 41*b* made of an insulating material, the trigger electrode 31 made of a metallic material, and the arc-extinguishing gas is reduced, and the electric insulation performance of the gas circuit breaker 1 is maintained.

The inner diameter of the guide portion 41*b* has a taper portion 41*d* that increases toward the drive device direction, and forms a truncated cone-shaped space inside the arc contactor (on the movable side) 41, thereby a sufficient flow rate is ensured by preventing separation of the arc-extinguishing gas flow during spraying.

The arc contactor (on the movable side) 41 is fixed by an insulation support member via the support 43 forming an outer circumference of the fixed contactor portion 4. The arc contactor (on the movable side) 41 is fixed by the support 43 and does not move. Therefore, the arc contactor (on the movable side) 41 is not included in a weight of a movable component driven by the driving device 9. Accordingly, the heat capacity and the surface area can be increased without increasing a driving force of the driving device 9, and can improve the durability of the arc contactor (on the movable side) 41.

The arc contactor (on the movable side) 41 is arranged to be separated from the arc contactor (on the fixed side) 21 at a distance which the insulation performance can be ensured after the arc is extinguished. Since the arc contactor (on the movable side) 41 and the arc contactor (on the fixed side) 21 are fixed and do not move, the surface area of the arc contactor (on the movable side) 41 can be increased without increasing a driving force of the driving device 9. Accordingly, the electric field distribution between the arc contactor (on the movable side) 41 and the arc contactor (on the fixed side) 21 can be more approximated to uniform electric field, and the distance between the arc contactor (on the movable side) 41 and the arc contactor (on the fixed side) 21 can be made shorter than the conventional technique.

In addition, the flow rate of the arc-extinguishing gas to be sprayed to the arc can be defined based on the distance between the insulation nozzle 23 and the arc contactor (on the fixed side) 21 and the distance between the insulation nozzle 23 and the arc contactor (on the movable side) 41. It is preferable that the distance between the arc contactor (on the fixed side) 21 and the insulation nozzle 23 is larger than the distance between the arc contactor (on the movable side) 41 and the insulation nozzle 23.

The fixed contactor portion 4 and the movable contactor portion 3 are configured to always have the same potential and to be always brought into a conductive state, via a sliding contact, etc. Since the trigger electrode 31 of the movable contactor portion 3 is inserted into the arc contactor (on the fixed side) 21 when the gas circuit breaker 1 is in the closed state, the fixed contactor portion 2 and the fixed contactor portion 4 are electrically connected via the movable contactor portion 3. When the gas circuit breaker 1 is in the closed state, the arc contactor (on the movable side) 41 serves as a conductor forming a part of an electrical circuit so that the lead-out conductors 7*a* and 7*b* are electrically connected.

On the other hand, since the trigger electrode 31 of the movable contactor portion 3 is separated from the arc contactor (on the fixed side) 21 of the fixed contactor portion 2 when the gas circuit breaker 1 is in the opened state, the arc contactor (on the movable side) 41 is electrically disconnected from the arc contactor (on the fixed side) 21.

However, when the gas circuit breaker 1 becomes the opened state, the trigger electrode 31 of the movable contactor portion 3 and the arc contactor (on the fixed side) 21 of the fixed contactor portion 2 are mechanically separated from each other, but are in an electrically conductive state by the generated arc. Accordingly, in a state in which the arc is present, the arc contactor (on the movable side) 41 and the arc contactor (on the fixed side) 21 are in an electrically conductive state.

When the gas circuit breaker 1 becomes the opened state, the movable contactor portion 3 is driven by the driving device 9, and moves between the arc contactor (on the fixed side) 21 and the arc contactor (on the movable side) 41 from the open-end direction side to the driving-device direction side. Accordingly, the trigger electrode 31 also moves between the arc contactor (on the fixed side) 21 and the arc contactor (on the movable side) 41 from the open-end direction side to the driving-device direction side. The fixed conductive contactor 22 and the movable conductive contactor 32 are separated from each other before the trigger electrode 31 is separated from the arc contactor (on the fixed side) 21. This is to produce the arc always at between the trigger electrode 31 and the arc contactor (on the fixed side) 21, not at between the fixed conductive contactor 22 and the movable conductive contactor 32.

The arc is generated between the trigger electrode 31 and the arc contactor (on the fixed side) 21 from a time point when the trigger electrode 31 starts to be separated from the arc contactor (on the fixed side) 21 until the separation distance between the arc contactor (on the fixed side) 21 and the arc contactor (on the movable side) 41 becomes equal to the separation distance between the arc contactor (on the fixed side) 21 and the trigger electrode 31.

When the separation distance between the arc contactor (on the fixed side) 21 and the arc contactor (on the movable side) 41 becomes equal to the separation distance between the arc contactor (on the fixed side) 21 and the trigger electrode 31, the arc is transferred from the trigger electrode 31 to the arc contactor (on the movable side) 41. The arc is generated between the arc contactor (on the movable side) 41 and the arc contactor (on the fixed side) 21 from a time point when the separation distance between the arc contactor (on the fixed side) 21 and the arc contactor (on the movable side) 41 becomes equal to the separation distance between the arc contactor (on the fixed side) 21 and the trigger electrode 31 until the arc is extinguished. At this time, the arc contactor (on the movable side) 41 and the arc contactor (on the fixed side) 21 form a pair of electrodes that are arranged to face each other, and bear the arc.

The trigger electrode 31 moves further in the driving-device direction, that is, in a direction in which the separation distance between the arc contactor (on the fixed side) 21 and the trigger electrode 31 becomes larger than the separation distance between the arc contactor (on the fixed side) 21 and the arc contactor (on the movable side) 41. This causes the trigger electrode 31 to be separated from the arc generated between the arc contactor (on the movable side) 41 and the arc contactor (on the fixed side) 21, reducing the degradation of the trigger electrode 31.

The trigger electrode 31 moves further in the driving-device direction. Then, a sealed state on the open-end direction side of the accumulation chamber 38 formed by the trigger electrode 31 and the arc contactor (on the movable side) 41 is opened. Therefore, the arc-extinguishing gas pressurized in the compression chamber 36 and stored in the accumulation chamber 38 is sprayed via the arc contactor (on the movable side) 41 and the insulation nozzle 23, and the arc between the arc contactor (on the fixed side) 21 and the arc contactor (on the movable side) 41 is extinguished.

When the trigger electrode 31 is moved by the driving device 9 in the driving-device direction, the arc is transferred from the trigger electrode 31 to the arc contactor (on the movable side) 41. The arc contactor (on the movable side) 41 and the arc contactor (on the fixed side) 21 serve as an electrical final contact point when the gas circuit breaker 1 becomes the opened state.

In addition, when the gas circuit breaker 1 becomes the opened state, it is preferable to reduce the degradation of the fixed conductive contactor 22 and the movable conductive contactor 32 due to the arc. Although the fixed conductive contactor 22 and the movable conductive contactor 32 are separated from each other, the arc contactor (on the fixed side) 21, the trigger electrode 31, and arc contactor (on the movable side) 41 bear the arc to prevent the arc from being generated between the fixed conductive contactor 22 and the movable conductive contactor 32. Therefore, the trigger electrode 31 and the arc contactor (on the fixed side) 21 contact each other while maintaining a sufficiently high electrical conductivity until the fixed conductive contactor 22 and the movable conductive contactor 32 are separated from each other, maintaining a good conductive state.

When the gas circuit breaker 1 becomes the opened state, the arc-extinguishing gas in the compression chamber 36 formed by the piston 33 of the movable contactor portion 3 and the cylinder 42 of the fixed contactor portion 4 is pressurized. The arc contactor (on the movable side) 41 and the trigger electrode 31 form the accumulation chamber 38 of this pressurized arc-extinguishing gas. In the stage in which the arc-extinguishing gas in the compression chamber 36 is pressurized by the piston 33 and the cylinder 42, the trigger electrode 31 is being inserted into the arc contactor (on the movable side) 41, and the accumulation chamber 38 is in the sealed state. Accordingly, the arc-extinguishing gas pressurized in the compression chamber 36 is stored in the accumulation chamber 38.

After the pressurization of the arc-extinguishing gas in the compression chamber 36 has completed or has advanced for a predetermined extent, the arc contactor (on the movable side) 41 and the trigger electrode 31 are separated, and the arc-extinguishing gas stored in the accumulation chamber 38 is sprayed to the arc space between the arc contactor (on the fixed side) 21 and the arc contactor (on the movable side) 41. In this way, the arc between the arc contactor (on the movable side) 41 and the arc contactor (on the fixed side) 21 is extinguished, and the arc contactor (on the movable side) 41 and the arc contactor (on the fixed side) 21 are electrically disconnected from each other.

Note that a tip of the arc contactor (on the movable side) 41 may be divided in a circumference direction to be a finger-like electrode. In this case, the arc contactor (on the movable side) 41 is flexible, and the inner diameter of an opening edge of the arc contactor (on the movable side) 41 is slightly smaller than the outer diameter of the trigger electrode 31 and is narrowed. When the trigger electrode 31 is inserted into an opening of the arc contactor (on the movable side) 41, the trigger electrode 31 and the arc contactor (on the movable side) 41 contact each other, and are connected.

(Cylinder 42)

The cylinder 42 is a cylindrical member formed of a metal conductor and has a bottom at one end and an opening at the other end. The cylinder 42 has a cylindrical inner wall inside and forms a torus-shaped space. The inner wall provided inside the cylinder 42 forming the torus-shaped space is formed by the arc contactor (on the movable side) 41. An outer wall forming an outer circumference portion of the cylinder 42 is configured to forma concentric circle with the arc contactor (on the movable side) 41.

The cylinder 42 has an inner diameter that is slidable with an outer diameter of the piston 33 of the movable contactor portion 3. Furthermore, the arc contactor (on the movable side) 41 forming the inner wall of the cylinder 42 has the outer diameter that is slidable with a hole diameter of the torus-shaped of the piston 33.

The cylinder 42 is arranged in the fixed contactor portion 4 so that the bottom is placed on the driving-device direction side and the opening is placed on the open-end direction side. The cylinder 42 is arranged in the arc-extinguishing gas. The bottom of the cylinder 42 has an insertion hole 42*a* into which the piston support 33*a* for supporting the piston 33 of the movable contactor portion 3 is inserted.

The piston 33 is inserted into the cylinder 42, and the compression chamber 36 for pressurizing the arc-extinguishing gas is formed by the cylinder 42 and the piston 33. When the gas circuit breaker 1 becomes the opened state, the cylinder 42 and the piston 33 compress the arc-extinguishing gas in the compression chamber 36. The cylinder 42 and the piston 33 ensure air-tightness of the compression chamber 36. In this way, the arc-extinguishing gas in the compression chamber 36 is pressurized.

A through hole 42*b* is provided in the arc contactor (on the movable side) 41 forming the inner wall of the cylinder 42. The through hole 42*b* connects the compression chamber 36 and the accumulation chamber 38 formed by the arc contactor (on the movable side) 41 and the trigger electrode 31. The arc-extinguishing gas pressurized in the compression chamber 36 is stored in the accumulation chamber 38, and is guided to the arc space via the insulation nozzle 23 when the sealing of the arc contactor (on the movable side) 41 is released by the trigger electrode 31.

The check valve 42*e* may be provided in the through hole 42*b* in the cylinder 42 communicating the inside of the compression chamber 36 and the accumulation chamber 38, to prevent the arc-extinguishing gas from flowing into the compression chamber 36 from the accumulation chamber 38 when the pressure in the compression chamber 36 is lower than that in the accumulation chamber 38.

When the gas circuit breaker 1 becomes the opened state, the cylinder 42 compresses the arc-extinguishing gas in the compression chamber 36 in cooperation with the piston 33. As a result, the arc-extinguishing gas in the compression chamber 36 is pressurized. The arc contactor (on the movable side) 41 and the trigger electrode 31 form the accumulation chamber 38 of this pressurized arc-extinguishing gas. In the stage in which the arc-extinguishing gas in the compression chamber 36 is pressurized by the piston 33 and the cylinder 42, the trigger electrode 31 is being inserted into the arc contactor (on the movable side) 41, and the accumulation chamber 38 is in the sealed state.

After the pressurization of the arc-extinguishing gas in the compression chamber 36 has completed or has advanced by a predetermined extent, the arc contactor (on the movable side) 41 and the trigger electrode 31 are separated from each other, and the arc-extinguishing gas pressurized in the compression chamber 36 flows through the accumulating chamber 38, and is sprayed to the arc space between the arc contactor (on the fixed side) 21 and the arc contactor (on the movable side) 41. In this way, the arc between the arc contactor (on the movable side) 41 and the arc contactor (on the fixed side) 21 is extinguished, and the arc contactor (on the movable side) 41 and the arc contactor (on the fixed side) 21 are electrically disconnected from each other.

The cylinder 42 compresses the arc-extinguishing gas in the compression chamber 36 in cooperation with the piston 33. Accordingly, the cylinder 42 and the piston 33 are in the sealed state when the arc-extinguishing gas is compressed, preventing a pressure leak. However, when an excessive pressure is continuously applied to the piston by the compressed arc-extinguishing gas, this may cause the reverse movement of the piston 33, the trigger electrode 31, and the movable conductive contactor 32. A hole including a pressure valve may be provided in the bottom of the cylinder 42 to prevent this reverse movement, so that the pressure is released by appropriately opening and closing the pressure valve. Alternatively, by arranging the check valve 42*e*, the reverse movement of the piston 33, the trigger electrode 31, and the movable conductive contactor 32 can be suppressed.

The cylinder 42 has an intake hole 42*c* in the bottom, and an air intake valve 42*d* arranged in the intake hole 42*c*. When the gas circuit breaker 1 becomes the closed state again, the movable contactor portion 3 is moved by the driving device 9 from the driving-device direction to the open-end direction side. Accordingly, the piston 33 also moves from the driving-device direction to the open-end direction. At this time, the compression chamber 36 formed by the piston 33 and the cylinder 42 is expanded, and the pressure in the compression chamber 36 decreases. When the pressure in the compression chamber 36 decreases, the arc-extinguishing gas in the sealed container 8 is sucked into the compression chamber 36 via the intake hole 42*c* and the air intake valve 42*d*. Since the sucked arc-extinguishing gas is sufficiently distant from the arc space that became a high temperature, the arc-extinguishing gas having a low temperature is filled in the compression chamber 36.

(Support 43)

The support 43 is a cylindrical conductor having a bottom in one end surface, and the bottom end surface is arranged on the driving-device direction side. The lead-out conductor 7*b* is connected to the support 43 via the sealed container 8. The support 43 is fixed to the sealed container 8 by an insulation member. The support 43 supports the arc contactor (on the movable side) 41 and the cylinder 42.

(Movable Contactor Portion 3)

The movable contactor portion 3 includes the trigger electrode 31, the movable conductive contactor 32, the piston 33, the insulation rod 37, and the accumulation chamber 38. In the conventional technique, the movable contactor includes a nozzle, a cylinder, and an arc electrode, resulting in large size. However, the present embodiment can achieve significant weight reduction. It is not necessary that the trigger electrode 31 and the piston 33 are integrated and simultaneously operated, but when the trigger electrode 31 and the piston 33 are integrated, it is possible to simplify the structure. Note that in some cases, it is advantageous in terms of breaking performance to have a structure that the trigger electrode 31 is moved more rapidly than the piston 33.

(Movable Conductive Contactor 32)

The movable conductive contactor 32 is a cylindrical electrode arranged on an end of the movable contactor portion 3 on the open-end direction side along the center axis of the cylinder of the movable contactor portion 3. The movable conductive contactor 32 is formed of a cylindrical metal conductor that is formed to have a rounded shape at the end on the open-end direction side. The metal forming the movable conductive contactor 32 is preferably aluminum having high electric conductivity and light weight, but may also be copper. It is preferable that the movable conductive contactor 32 is reduced in weight to be movable.

The movable conductive contactor 32 has an outer diameter that contacts and is slidable with an inner diameter of the fixed conductive contactor 22 of the fixed contactor portion 2. The movable conductive contactor 32 is arranged on a surface of the piston 33 on the open-end direction side.

When the gas circuit breaker 1 is in the closed state, the movable conductive contactor 32 is inserted into the fixed conductive contactor 22 of the fixed contactor portion 2. Accordingly, the movable conductive contactor 32 contacts with the fixed conductive contactor 22, and the movable contactor portion 3 and the fixed contactor portion 2 are electrically connected to each other. The movable conductive contactor 32 has the capability of applying a rated current when being conducted.

On the other hand, when the gas circuit breaker 1 is in the opened state, the movable conductive contactor 32 is physically separated from the fixed conductive contactor 22 of the fixed contactor portion 2, and the movable contactor portion 3 and the fixed contactor portion 2 are electrically disconnected from each other.

The movable conductive contactor 32 is formed integrally with the piston 33 formed by the conductor. When the gas circuit breaker 1 is in the closed state and in the opened state, the piston 33 is inserted into and contacts the cylinder 42 of the fixed contactor portion 4, and the movable contactor portion 3 and the fixed contactor portion 4 are electrically connected to each other. Since the piston 33 slides in the cylinder 42 of the fixed contactor portion 4, the movable contactor portion 3 and the fixed contactor portion 4 are electrically connected to each other regardless of whether the gas circuit breaker 1 is in the closed state or in the opened state.

(Trigger Electrode 31)

The trigger electrode 31 is a bar-shaped electrode that is arranged on an end of the movable contactor portion 3 on the open-end direction side along the center axis of the cylinder of the movable contactor portion 3. The trigger electrode 31 is formed of a metal conductor formed into a solid columnar shape which one end is rounded by shaving, etc. At least tip of the trigger electrode 31 is made of metal containing 10% to 40% of copper and 90% to 60% of tungsten, etc.

The trigger electrode 31 has an outer diameter that contacts and is slidable with an inner diameter of the arc contactor (on the fixed side) 21 of the fixed contactor portion 2. The trigger electrode 31 is arranged on the inner side of the arc contactor (on the movable side) 41. The trigger electrode 31 is arranged inside the guide portion 41*b* of the arc contactor (on the movable side) 41 so that it is advantageous in terms of the durability in view of the heat capacity, and in terms of the weight and the surface area.

Note that the trigger electrode 31 is connected to the insulation rod 37, together with the piston 33, and this insulation rod 37 is driven by the driving device 9 and the trigger electrode 31 reciprocates between the fixed contactor portion 2 and the fixed contactor portion 4. The trigger electrode 31 is movable relative to the arc contactor (on the fixed side) 21. The trigger electrode 31 is arranged in the arc-extinguishing gas, and bears the arc discharge generated in the arc-extinguishing gas.

When the gas circuit breaker 1 becomes the opened state, it is required to break the current quickly. To operate the movable contactor portion 3 at high speed, it is preferable that the trigger electrode 31 is also reduced in weight. However, when the trigger electrode 31 is reduced in weight, the durability of the trigger electrode 31 against the arc becomes insufficient.

However, the period of time required for the trigger electrode 31 to bear the arc is about 5 to 10 ms in the initial stage in which the trigger electrode 31 starts to move. In the latter of the period of time during which the trigger electrode 31 moves, the heat stress received by the trigger electrode 31 acceleratedly increases, but the arc is transferred to the arc contactor (on the movable side) 41. Accordingly, the durability of the trigger electrode 31 against the arc is not affected by the weight reduction of the trigger electrode 31.

It is preferable that the durability of the arc contactor (on the fixed side) 21, the durability of the arc contactor (on the movable side) 41, and the durability of the trigger electrode 31 have the following relation.

The durability of the arc contactor (on the fixed side) 21 the≥durability of the arc contactor (on the movable side) 41 the≥durability of the trigger electrode 31

This is because the arc contactor (on the fixed side) 21 is more likely to wear compared to the arc contactor (on the movable side) 41 for the arc-extinguishing gas flow that has become a high temperature is accelerated and thereafter collides with the arc contactor 21. In addition, this is because it is preferable that the trigger electrode 31 that is a movable component is made more lightweight than each of the arc contactor (on the fixed side) 21 and the arc contactor (on the movable side) 41, and a wear level of the trigger electrode 31 is small compared to that on the arc contactor (on the fixed side) 21 and that on the arc contactor (on the movable side) 41 for the high-temperature arc is ignited only for a certain period of time until the arc is commutated to the arc contactor (on the movable side) 41.

The trigger electrode 31 can be reduced in weight by reducing the durability. When the trigger electrode 31 is reduced in weight, the gas circuit breaker 1 can become the closed state more quickly using the driving device 9 having the same driving force, improving the breaking performance. In addition, when the trigger electrode 31 is driven at the same speed, the driving force of the driving device 9 can be reduced, resulting in reduction in weight and size of the driving device 9.

On the other hand, since the arc contactor (on the movable side) 41 is an unmovable and fixed component, the disadvantage of the weight of the arc contactor (on the movable side) 41 being large is small, and the arc contactor (on the movable side) 41 can be increased in thickness. As a result, the arc contactor (on the movable side) 41 can have higher durability than the trigger electrode 31.

Since the trigger electrode 31 and the arc contactor (on the movable side) 41 form the accumulation chamber 38, the same level of pressure as that of the arc-extinguishing gas pressurized in the compression chamber 36 is applied to the trigger electrode 31 and the arc contactor (on the movable side) 41. It is preferable that the trigger electrode 31 and the guide portion 41*b* of the arc contactor (on the movable side)

41 contact with each other to prevent the pressure leak of the pressurized arc-extinguishing gas.

It is preferable that a contact portion between the trigger electrode 31 and the guide portion 41*b* of the arc contactor (on the movable side) 41 has a predetermined length in the axial direction to enhance the air tightness of the arc-extinguishing gas pressurized in the compression chamber 36 and to prevent the aging degradation of the air tightness.

A spraying amount, a spray passage, etc., of the arc-extinguishing gas are controlled based on shapes of or a distance between the trigger electrode 31 and the guide portion 41*b* of the arc contactor (on the movable side) 41.

When the gas circuit breaker 1 is in the closed state, the trigger electrode 31 is inserted into the arc contactor (on the fixed side) 21 of the fixed contactor portion 2. Accordingly, the trigger electrode 31 contacts with the arc contactor (on the fixed side) 21 of the fixed contactor portion 2 and with the arc contactor (on the movable side) 41 of the fixed contactor portion 4, and the fixed contactor portion 2, the movable contactor portion 3, and the fixed contactor portion 4 are electrically connected. When the gas circuit breaker 1 is in the closed state, the trigger electrode 31 serves as a conductor forming apart of a current circuit so that the lead-out conductors 7*a* and 7*b* are electrically connected to each other.

On the other hand, when the gas circuit breaker 1 becomes the opened state, the trigger electrode 31 is separated from the arc contactor (on the fixed side) 21 of the fixed contactor portion 2. Accordingly, the trigger electrode 31 bears the arc generated between the movable contactor portion 3 and the fixed contactor portion 2. The movable conductive contactor 32 and the fixed conductive contactor 22 of the fixed contactor portion 2 are separated from each other before the arc contactor (on the fixed side) 21 and the trigger electrode 31 are separated from each other and after the current is commutated to the arc contactor (on the fixed side) 21 side and the trigger electrode 31 side, and the arc is not generated between the movable conductive contactor 32 and the fixed conductive contactor 22. The trigger electrode 31 forms a pair of electrodes arranged to face the arc contactor (on the fixed side) 21, and serves as one of electrodes that contact the arc when the gas circuit breaker 1 becomes the opened state.

The arc generated when the gas circuit breaker 1 is in the opened state concentrates between the trigger electrode 31 and the arc contactor (on the fixed side) 21. The arc can be prevented from being generated between the movable conductive contactor 32 and the fixed conductive contactor 22, reducing the degradation of the movable conductive contactor 32 and the fixed conductive contactor 22.

When the gas circuit breaker 1 becomes the opened state, the movable contactor portion 3 is driven by the driving device 9, and moves between the arc contactor (on the fixed side) 21 and the arc contactor (on the movable side) 41 from the open-end direction side to the driving-device direction side. Accordingly, the trigger electrode 31 also moves between the arc contactor (on the fixed side) 21 and the arc contactor (on the movable side) 41 from the open-end direction side to the driving-device direction side. The fixed conductive contactor 22 and the movable conductive contactor 32 are separated from each other before the trigger electrode 31 is separated from the arc contactor (on the fixed side) 21. This is not to cause the arc to be generated between the fixed conductive contactor 22 and the movable conductive contactor 32.

The arc is generated between the trigger electrode 31 and the arc contactor (on the fixed side) 21 from a time point when the trigger electrode 31 starts to be separated from the arc contactor (on the fixed side) 21 until the separation distance between the arc contactor (on the fixed side) 21 and the arc contactor (on the movable side) 41 becomes equal to the separation distance between the arc contactor (on the fixed side) 21 and the trigger electrode 31.

When the separation distance between the arc contactor (on the fixed side) 21 and the arc contactor (on the movable side) 41 becomes equal to the separation distance between the arc contactor (on the fixed side) 21 and the trigger electrode 31, the arc is transferred from the trigger electrode 31 to the arc contactor (on the movable side) 41. The arc is generated between the arc contactor (on the movable side) 41 and the arc contactor (on the fixed side) 21 from a time point when the separation distance between the arc contactor (on the fixed side) 21 and the arc contactor (on the movable side) 41 becomes equal to the separation distance between the arc contactor (on the fixed side) 21 and the trigger electrode 31 until the arc is extinguished. At this time, the arc contactor (on the movable side) 41 and the arc contactor (on the fixed side) 21 form a pair of electrodes that are arranged to face each other, and bear the arc.

The trigger electrode 31 moves further in the driving-device direction, that is, in a direction in which the separation distance between the arc contactor (on the fixed side) 21 and the trigger electrode 31 becomes larger than the separation distance between the arc contactor (on the fixed side) 21 and the arc contactor (on the movable side) 41. This causes the trigger electrode 31 to be separated from the arc generated between the arc contactor (on the movable side) 41 and the arc contactor (on the fixed side) 21, reducing the degradation of the trigger electrode 31.

The trigger electrode 31 moves further in the driving-device direction. Then, a sealed state on the open-end direction side of the accumulation chamber 38 formed by the trigger electrode 31 and the arc contactor (on the movable side) 41 is opened. Thus, the arc-extinguishing gas that is pressurized in the compression chamber 36 and is stored in the accumulation chamber 38 formed by the trigger electrode 31 and the arc contactor (to be movable side) 41 is sprayed via the insulation nozzle 23, and the arc between the arc contactor (on the fixed side) 21 and the arc contactor (on the movable side) 41 is extinguished.

When the gas circuit breaker 1 becomes the opened state, the cylinder 42 compresses the arc-extinguishing gas in the compression chamber 36 in cooperation with the piston 33. As a result, the arc-extinguishing gas in the compression chamber 36 is pressurized. The arc contactor (on the movable side) 41 and the trigger electrode 31 form the accumulation chamber 38 of this pressurized arc-extinguishing gas. In the stage in which the arc-extinguishing gas in the compression chamber 36 is pressurized by the piston 33 and the cylinder 42, the trigger electrode 31 is being inserted into the arc contactor (on the movable side) 41, and the accumulation chamber 38 is in the sealed state.

After the pressurization of the arc-extinguishing gas in the compression chamber 36 has completed or has advanced for a predetermined extent or more, the arc contactor (on the movable side) 41 and the trigger electrode 31 are separated from each other, and the arc-extinguishing gas pressurized in the compression chamber 36 and stored in the accumulation chamber 38 is sprayed to the arc space between the arc contactor (on the fixed side) 21 and the arc contactor (on the movable side) 41. In this way, the arc between the arc contactor (on the movable side) 41 and the arc contactor (on the fixed side) 21 is extinguished, and the arc contactor (on the movable side) 41 and the arc contactor (on the fixed side)

21 are electrically disconnected from each other. After the arc is extinguished, the arc current does not flow in the trigger electrode 31.

The movement of the trigger electrode 31 relative to the arc contactor (on the fixed side) 21 and the arc contactor (on the movable side) 41 is caused by the insulation rod 37 that is fixed to and supported by the trigger electrode 31 and the piston 33. The insulation rod 37 is driven by the driving device 9. The insulation rod 37 is made of an insulating material. The insulation rod 37 is arranged on the center axes of the trigger electrode 31, the arc contactor (on the fixed side) 21, and the arc contactor (on the movable side) 41.

The trigger electrode 31 may include a suppressing portion for suppressing disturbance of the arc. The trigger electrode 31 may include a rectifying portion for rectifying the arc-extinguishing gas flowing in the accumulation chamber 38, to direct the gas to the arc. The suppressing portion for suppressing disturbance of the arc and the rectifying portion for rectifying the arc-extinguishing gas may be configured integrally with the trigger electrode 31.

(Piston 33)

The piston 33 is a torus-shaped plate arranged on an end surface of the movable contactor portion 3 on the open-end direction side of the movable contactor. The piston 33 includes the movable conductive contactor 32 on a surface on the open-end direction side. The piston 33 is formed of a metal conductor formed into a torus-shaped plate by shaving, etc.

The piston 33 has an outer diameter that is slidable with an inner diameter of the cylinder 42 of the fixed contactor portion 4. The piston 33 has a hole diameter of the torus-shape that is slidable with an outer circumference of the arc contactor (on the movable side) 41 forming the inner wall of the cylinder 42 of the fixed contactor portion 4.

The piston 33 includes a plurality of piston supports 33*a* connected to the surface on the driving-device direction side. The piston support 33*a* is a member that is formed by a metal conductor formed into a rod shape. The piston supports 33*a* fix the piston 33 to the trigger electrode 31 via the insertion hole 42*a* of the cylinder 42. The piston 33 is connected to the insulation rod 37 via the piston supports 33*a* and the trigger electrode 31.

The piston 33 is slidably inserted into and arranged in the cylinder 42 of the fixed contactor portion 4. The compression chamber 36 for pressurizing the arc-extinguishing gas is formed by the piston 33 and the cylinder 42. The piston 33 is arranged in the arc-extinguishing gas.

The piston 33 reciprocates via the insulation rod 37 by the driving device 9. The reciprocation by the driving device 9 is performed when the gas circuit breaker 1 becomes the closed state and becomes the opened state.

When the gas circuit breaker 1 becomes the opened state, the piston 33 compresses the arc-extinguishing gas in the compression chamber 36 in cooperation with the cylinder 42. As a result, the arc-extinguishing gas in the compression chamber 36 is pressurized. The trigger electrode 31 and the arc contactor (on the movable side) 41 form the accumulation chamber 38 for storing this pressurized arc-extinguishing gas.

The accumulation chamber 38 communicates with the compression chamber 36 through the through hole 42*b* provided in the cylinder 42. In the stage in which the arc-extinguishing gas in the compression chamber 36 is pressurized by the piston 33 and the cylinder 42, the trigger electrode 31 is inserted into the arc contactor (on the movable side) 41, so that the accumulation chamber 38 is in the sealed state, preventing the pressure leak. Accordingly, the arc-extinguishing gas pressurized to the same pressure is filled in the compression chamber 36 and the accumulation chamber 38. The check valve 42*e* may be provided in the through hole 42*b* in the cylinder 42 communicating the inside of the compression chamber 36 and the accumulation chamber 38, to prevent the arc-extinguishing gas from flowing into the compression chamber 36 from the accumulation chamber 38 when the pressure in the compression chamber 36 is lower than that in the accumulation chamber 38. This can suppress the pressure in the accumulation chamber 38 which supplies the arc-extinguishing gas to the arc space between the arc contactor (on the movable side) 41 and the arc contactor (on the fixed side) 21 from being greatly decreased by the pressure in the compression chamber 36 when the gas circuit breaker 1 is in the opened state, even when the movable contactor portion 3 reversely moves in the open-end direction.

In addition, in the stage in which the arc-extinguishing gas in the compression chamber 36 is pressurized, the compression chamber 36 formed by the piston 33 and the cylinder 42 and the accumulation chamber 38 formed by the trigger electrode 31 and the arc contactor (on the movable side) 41 are maintained in the sealed state, and are separated from the arc. Since the arc-extinguishing gas is less affected by the heat of the arc, the pressurized arc-extinguishing gas in the compression chamber 36 and the accumulation chamber 38 has a low temperature. The arc-extinguishing gas having a low temperature is sprayed to the arc between the arc contactor (on the movable side) 41 and the arc contactor (on the fixed side) 21, and the arc is efficiently extinguished.

The piston 33 receives the pressure of the arc generated between the trigger electrode 31 or the arc contactor (on the movable side) 41 and the arc contactor (on the fixed side) 21 and the pressure of the arc-extinguishing gas that is heated to a high temperature by the arc, and these pressures act as a force to move the entire movable contactor portion 3 toward the driving-device direction. This can reduce the output of the driving device 9, resulting in reduction in size of the driving device 9.

After the pressurization of the arc-extinguishing gas in the compression chamber 36 has completed or has advanced by a predetermined extent or more, the trigger electrode 31 and the arc contactor (on the movable side) 41 are separated from each other, and the arc-extinguishing gas that is pressurized in the compression chamber 36 and stored in the accumulation chamber 38 is sprayed to the arc space between the arc contactor (on the fixed side) 21 and the arc contactor (on the movable side) 41. In this way, the arc between the arc contactor (on the movable side) 41 and the arc contactor (on the fixed side) 21 is extinguished, and the arc contactor (on the movable side) 41 and the arc contactor (on the fixed side) 21 are electrically disconnected from each other.

The heat by the arc generated between the arc contactor (on the fixed side) 21 and the trigger electrode 31 or between the arc contactor (on the fixed side) 21 and the arc contactor (on the movable side) 41, and the arc-extinguishing gas that is heated to a high temperature by the arc pass through the exhaust ports 24*a*, 24*b*, and 24*c* at the same time as the generation of the arc, and are exhausted into the sealed container 8 quickly.

(Insulation Rod 37)

The insulation rod 37 is a bar-shaped member made of the insulating material. The trigger electrode 31 and the piston 33 are fixed to the open-end direction side of the insulation rod 37. The driving-device direction side of the insulation rod 37 is connected to the driving device 9.

The insulation rod 37 is arranged on the center axes of the trigger electrode 31, the arc contactor (on the fixed side) 21, and the arc contactor (on the movable side) 41. The trigger electrode 31 stands on the end portion of the insulation rod 37 on the open-end direction side.

The insulation rod 37 reciprocates the trigger electrode 31 and the piston 33 while maintaining the electric insulation performance between the driving device 9 and the sealed container 8. The reciprocation of the insulation rod 37 is performed by the driving device 9. The reciprocation by the driving device 9 is performed when the gas circuit breaker 1 becomes the closed state and becomes the opened state.

1-3. Action

Next, the action of the gas circuit breaker 1 of the present embodiment will be described based on FIGS. 1 to 3.

[A. A Case where the Gas Circuit Breaker 1 is in the Closed State]

Firstly, a case where the gas circuit breaker 1 of the present embodiment is in the closed state will be described. When in the closed state, the gas circuit breaker 1 conducts the current flowing in the lead-out conductors 7*a* and 7*b*.

In the case where the gas circuit breaker 1 of the present embodiment is in the closed state, the fixed contactor portion 2 and the fixed contactor portion 4 are electrically connected to each other via the movable contactor portion 3, and the current flows between the lead-out conductors 7*a* and 7*b*. Specifically, the movable conductive contactor 32 of the movable contactor portion 3 is inserted into the fixed conductive contactor 22 of the fixed contactor portion 2. In this way, the fixed conductive contactor 22 contacts with the movable conductive contactor 32, and the fixed contactor portion 2 and the movable contactor portion 3 are brought into an electrically conductive state.

In addition, the trigger electrode 31 of the movable contactor portion 3 is inserted into the arc contactor (on the fixed side) 21 of the fixed contactor portion 2. In this way, the arc contactor (on the fixed side) 21 contacts the trigger electrode 31, and the fixed contactor portion 2 and the movable contactor portion 3 are brought into an electrically conductive state.

Furthermore, the piston 33 of the movable contactor portion 3 is inserted into the cylinder 42 of the fixed contactor portion 4. The piston 33 and the movable conductive contactor 32 are formed integrally with each other and are electrically connected to each other. This enables the movable conductive contactor 32 to be electrically connected to the cylinder 42, and the fixed contactor portion 4 and the movable contactor portion 3 are brought into an electrically conductive state.

As a result, the fixed contactor portion 2 and the fixed contactor portion 4 are electrically connected to each other via the movable contactor portion 3, and the lead-out conductors 7*a* and 7*b* are brought into an electrically conductive state.

In this state, the arc is not generated in the space between the trigger electrode 31 or the arc contactor (on the movable side) 41 and the arc contactor (on the fixed side) 21. In addition, the pressure of the arc-extinguishing gas is uniformly applied to each portion in the sealed container 8. Accordingly, the arc-extinguishing gas in the compression chamber 36 formed by the piston 33 of the movable contactor portion 3 and the cylinder 42 of the fixed contactor portion 4 is not pressurized. In addition, the arc-extinguishing gas in the accumulation chamber 38 is not pressurized.

When the gas circuit breaker 1 is in the closed state, the pressure of the arc-extinguishing gas in the sealed container 8 is uniform. Accordingly, the gas flow of the arc-extinguishing gas is not generated.

[B. A Case where the Gas Circuit Breaker 1 Becomes the Opened State]

Next, a case where the gas circuit breaker 1 of the present embodiment becomes the opened state will be described. The gas circuit breaker 1 is in the opened state, and the current flowing between the lead-out conductors 7*a* and 7*b* is broken.

The breaking operation for opening the gas circuit breaker 1 into the opened state is performed in the case where the gas circuit breaker 1 is switched from the conductive state to the breaking state to break a fault current or a load current or to switch a power transmission circuit.

When the gas circuit breaker 1 is switched from the closed state to the opened state, the driving device 9 is driven. The movable contactor portion 3 is moved by the driving device 9 along the axis in the fixed contactor portion 4 in the driving-device direction. In this way, the movable conductive contactor 32 is separated from the fixed conductive contactor 22 and the trigger electrode 31 is separated from the arc contactor (on the fixed side) 21.

When the gas circuit breaker 1 becomes the opened state, the movable contactor portion 3 is driven by the driving device 9, and moves between the fixed contactor portion 2 and the fixed contactor portion 4 from the open-end direction side to the driving-device direction side. Accordingly, the movable conductive contactor 32 is separated from the fixed conductive contactor 22, and moves from the open-end direction side to the driving-device direction side.

Furthermore, the trigger electrode 31 also moves between the arc contactor (on the fixed side) 21 and the arc contactor (on the movable side) 41 from the open-end direction side to the driving-device direction side. The fixed conductive contactor 22 and the movable conductive contactor 32 are separated from each other before the trigger electrode 31 is separated from the arc contactor (on the fixed side) 21. In this way, the current to be broken is commutated to the trigger electrode 31 and the arc contactor (on the fixed side) 21 side, so that the arc is not generated between the fixed conductive contactor 22 and the movable conductive contactor 32.

The arc is generated between the trigger electrode 31 and the arc contactor (on the fixed side) 21 from a time point when the trigger electrode 31 starts to be separated from the arc contactor (on the fixed side) 21 until the separation distance between the arc contactor (on the fixed side) 21 and the arc contactor (on the movable side) 41 becomes equal to the separation distance between the arc contactor (on the fixed side) 21 and the trigger electrode 31.

When the separation distance between the arc contactor (on the fixed side) 21 and the arc contactor (on the movable side) 41 becomes equal to the separation distance between the arc contactor (on the fixed side) 21 and the trigger electrode 31, the arc is transferred from the trigger electrode 31 to the arc contactor (on the movable side) 41. The arc is generated between the arc contactor (on the movable side) 41 and the arc contactor (on the fixed side) 21 from a time point when the separation distance between the arc contactor (on the fixed side) 21 and the arc contactor (on the movable side) 41 becomes equal to the separation distance between the arc contactor (on the fixed side) 21 and the trigger electrode 31 until the arc is extinguished. At this time, the arc contactor (on the movable side) 41 and the arc contactor (on the fixed side) 21 form a pair of electrodes that are arranged to face each other, and bear the arc.

The trigger electrode 31 moves further in the driving-device direction, that is, in a direction in which the separation distance between the arc contactor (on the fixed side) 21 and the trigger electrode 31 becomes larger than the separation distance between the arc contactor (on the fixed side) 21 and the arc contactor (on the movable side) 41. This causes the trigger electrode 31 to be separated from the arc generated between the arc contactor (on the movable side) 41 and the arc contactor (on the fixed side) 21, reducing the degradation of the trigger electrode 31.

Since the movable contactor portion 3 is driven by the driving device 9 when the gas circuit breaker 1 of the present embodiment becomes the opened state, the piston 33 also moves from the open-end direction side to the driving-device direction side. The piston 33 compresses the arc-extinguishing gas in the compression chamber 36 in cooperation with the cylinder 42. As a result, the arc-extinguishing gas in the compression chamber 36 is pressurized. The arc contactor (on the movable side) 41 and the trigger electrode 31 form the accumulation chamber 38 for storing this pressurized arc-extinguishing gas. In the stage in which the arc-extinguishing gas in the compression chamber 36 is pressurized by the piston 33 and the cylinder 42, the trigger electrode 31 is inserted into the arc contactor (on the movable side) 41, so that the accumulation chamber 38 is in the sealed state.

The trigger electrode 31 is driven by the driving device 9, and further moves in the driving-device direction. After the pressurization of the arc-extinguishing gas in the compression chamber 36 has completed or has advanced by a predetermined extent, the arc contactor (on the movable side) 41 and the trigger electrode 31 are separated from each other, and a spraying port potion is formed in the end portion of the arc contactor (on the movable side) 41 on the open-end direction side. The arc-extinguishing gas that is pressurized in the compression chamber 36 and stored in the accumulation chamber 38 is sprayed from the spraying port portion to the arc space between the arc contactor (on the fixed side) 21 and the arc contactor (on the movable side) 41. In this way, the arc between the arc contactor (on the movable side) 41 and the arc contactor (on the fixed side) 21 is extinguished, and the arc contactor (on the movable side) 41 and the arc contactor (on the fixed side) 21 are electrically disconnected from each other.

The trigger electrode 31 is driven by the driving device 9, and further moves in the driving-device direction. As shown in FIG. 4, the guide portion 41*b* is arranged in the open-end direction in the cylinder of the conductive portion 41*a* of the arc contactor (on the movable side) 41. The guide portion 41*b* contacts the trigger electrode 31 and guides the movement of the trigger electrode 31. The guide portion 41*b* suppresses the mechanical vibration due to the movement of the trigger electrode 31 during the current breaking action.

The guide portion 41*b* guides the movement of the trigger electrode 31, and prevents the trigger electrode 31 from contacting, sliding, or approaching and separating from the insulation nozzle 23 made of an insulating material and the contact end 41*c* of the arc contactor (on the movable side) 41 made of a metallic material.

The guide portion 41*b* guides the movement of the trigger electrode 31, and prevents the trigger electrode 31 from approaching the insulation nozzle 23. Therefore, the generation of the triple junction due to the insulation nozzle 23 made of an insulating material, the trigger electrode 31 made of a metallic material, and the arc-extinguishing gas is suppressed.

The guide portion 41*b* has an inner diameter larger than an outer diameter of the trigger electrode 31, and smaller than an inner diameter of the contact end 41*c* portion of the arc contactor (on a movable side) 41 which is close to the trigger electrode 31. The guide portion 41*b* suppresses the mechanical vibration during the movement of the trigger electrode 31. Therefore, the trigger electrode 31 and the contact end 41*c* of the arc contactor (on the movable side) 41 are prevented from approaching and separating from each other. As a result, the current of the trigger electrode 31 is reduced from being shunted to the contact end 41*c* of the arc contactor (on the movable side) 41 due to the discharge, and the formation of the concave portion due to the discharge mark is suppressed.

When a concave portion is formed on the contact end 41*c* of the arc contactor (on the movable side) 41 due to the discharge mark, the arc-extinguishing gas leaks from this concave portion and the pressure decreases, and the velocity of the arc-extinguishing gas sprayed to the arc may decrease.

The gas circuit breaker pressurizes the arc-extinguishing gas, sprays the pressurized arc-extinguishing gas to the arc to extinguish the arc. Therefore, it is not desirable that the pressure of the arc-extinguishing gas pressurized at the time of spraying to the arc be lowered and the spraying velocity be slowed. Because the decrease in pressure of the arc-extinguishing gas that has been pressurized reduces the flow velocity of the arc-extinguishing gas and make it difficult to reliably extinguish the arc.

However, the guide portion 41*b* guides the movement of the trigger electrode 31, and the discharge from the trigger electrode 31 to the contact end 41*c* of the arc contactor (on the movable side) 41 is suppressed. As a result, the leakage of the arc-extinguishing gas from the concave potion due to the discharge mark is suppressed, and the velocity of the arc-extinguishing gas sprayed to the arc is secured.

The guide portion 41*b* guides the movement of the trigger electrode 31, and suppresses the trigger electrode 31 from contacting or sliding the contact end 41*c* of the arc contactor (on the movable side) 41. Therefore, the trigger electrode 31 and the contact end 41*c* of the arc contactor (on the movable side) 41 are prevented from being shaved, and the generation of fine metal foreign materials (so-called swarf) is reduced.

When the generated metal foreign materials are present in the high electric field portion, the electric insulation performance of the gas circuit breaker 1 may be threatened. However, it is possible to reduce the risk that the metal surfaces of the contact end 41*c* of the trigger electrode 31 and the arc contactor (on the movable side) 41 come into contact with each other during driving, and fine metal foreign materials are generated. Since the deterioration of the electric insulation performance of the gas circuit breaker due to the fine metal foreign materials is suppressed, the electric insulation performance of the gas circuit breaker 1 can be more reliably maintained.

Further, the guide portion 41*b* is arranged in the cylinder of the conductive portion 41*a* of the arc contactor (on the movable side) 41 so as to be separated from an end in the open-end direction (arc-contactor-(on the fixed side)-21 side) of the arc contactor (on the movable side) 41 by at least the distance L obtained by multiplying the inner diameter DD of the contact end 41*c* of the arc contactor (on a movable side) 41 by 0.2. As a result, as shown in FIG. 5, the electric field strength at the contact portion of the guide portion 41*b* and the trigger electrode 31 is reduced.

FIG. 5 shows the relation, calculated by simulation, between the ratio of the inner diameter DD and the distance L and the electric field strength at the contact portion between the guide portion 41*b* and the trigger electrode 31. The inner diameter DD is the inner diameter of the contact end 41*c* of the arc contactor (on the movable side) 41, and the distance L is a distance from the end portion, in the open-end direction (arc-contactor-(on the fixed side)-21 side), of the arc contactor (on the movable side) 41 in which the guide portion 41*b* is arranged.

The guide portion 41*b* is made of at least one of insulating materials among acrylic, polycarbonate, polystyrene, polyethylene, polypropylene, polyolefin, and PTFE. The above insulating materials have a relative dielectric constant of 2.1 to 3.0. In FIG. 5, the electric field strength of an insulating material having a relative dielectric constant of 3.0 is shown by a solid line, and the electric field strength of an insulating material having a relative dielectric constant of 2.1 is shown by a dotted line.

As shown in FIG. 5, by setting the ratio of the inner diameter DD and the distance L to be 0.2 or more, the electric field strength can be remarkably suppressed. The guide portion 41*b* is arranged in the cylinder of the conductive portion 41*a* of the arc contactor (on the movable side) 41 so as to be separated from an end in the open-end direction (arc-contactor-(on the fixed side)-21 side) of the arc contactor (on the movable side) 41 by at least the distance L obtained by multiplying the inner diameter DD of the contact end 41*c* of the arc contactor (on a movable side) 41 by 0.2. As a result, the electric field strength at the contact portion of the guide portion 41*b* and the trigger electrode 31 is reduced.

Therefore, the triple junction due to the guide portion 41*b* made of an insulating material, the trigger electrode 31 made of a metallic material, and the arc-extinguishing gas is reduced, and the electric insulation performance of the gas circuit breaker 1 is maintained.

The inner diameter of the guide portion 41*b* has a taper portion 41*d* that increases toward the drive device direction, and forms a truncated cone-shaped space inside the arc contactor (on the movable side) 41. The taper portion 41*d* of the guide portion 41*b* smoothly guides the arc-extinguishing gas from inside the arc contactor (on the movable side) 41 toward the insulation nozzle 23.

The insulation nozzle 23 guides the arc-extinguishing gas flowing through the accumulation chamber 38 and sprayed from the spraying port portion, to the arc space between the arc contactor (on the fixed side) 21 and the arc contactor (on the movable side) 41.

The throat portion 23*a* of the insulation nozzle 23 pressurizes the arc-extinguishing gas to increase the flow velocity of the arc-extinguishing gas to be sprayed to the arc in an enlarged flow passage on the downstream side of the throat portion 23*a*. The throat portion 23*a* of the insulation nozzle 23 concentrates the pressurized arc-extinguishing gas in the arc space. In addition, the insulation nozzle 23 defines the exhaust passage of the arc-extinguishing gas that is heated to a high temperature by the arc. Furthermore, the insulation nozzle 23 suppresses expansion of the arc using the throat portion 23*a*, and defines the maximum diameter of the arc. The insulation nozzle 23 controls the flow rate of the arc-extinguishing gas using the throat portion 23*a*. This enables the arc-extinguishing gas to be efficiently sprayed to the arc generated between the arc contactor (on the movable side) 41 and the arc contactor (on the fixed side) 21, so that the arc is extinguished. As a result, the arc contactor (on the movable side) 41 and the arc contactor (on the fixed side) 21 are electrically disconnected from each other.

The insulation nozzle 23 is arranged so as to circulate around the trigger electrode 31, and reduces the decrease in the spraying velocity of the arc-extinguishing gas due to the pressure decrease at the time of spraying to the arc.

The gas circuit breaker pressurizes the arc-extinguishing gas, sprays the pressurized arc-extinguishing gas to the arc to extinguish the arc. Therefore, it is not desirable that the pressure of the arc-extinguishing gas pressurized at the time of spraying to the arc be lowered and the spraying velocity be slowed. Because the decrease in pressure of the arc-extinguishing gas that has been pressurized reduces the flow velocity of the arc-extinguishing gas and make it difficult to reliably extinguish the arc. Therefore, it is desirable to reduce the separation distance (clearance) between the insulation nozzle 23 and the trigger electrode 31 in order to reduce the leakage of the arc-extinguishing gas when it is sprayed to the arc.

On the other hand, when the separation distance (clearance) between the insulation nozzle 23 and the trigger electrode 31 is reduced, the pressure decrease due to the leakage of the pressurized arc-extinguishing gas is reduced. However, when the separation distance (clearance) between the insulation nozzle 23 and the trigger electrode 31 becomes too small, the metal, the insulator, and the arc-extinguishing gas come into contact with each other at the throat portion 23*a* of the insulation nozzle 23, and the triple junction in which the electric field strength is extremely high is generated.

The triple junction in which the metal, the insulator, and the arc-extinguishing gas contact with each other has an extremely high electric field strength, which may threaten the electric insulation performance of the gas circuit breaker.

The guide portion 41*b* of the arc contactor (on a movable side) 41 guides the movement of the trigger electrode 31, and prevents the trigger electrode 31 from approaching the insulation nozzle 23. Therefore, even when the separation distance (clearance) between the insulation nozzle 23 and the trigger electrode 31 is reduced, the generation of the triple junction due to the insulation nozzle 23 made of an insulating material, the trigger electrode 31 made of a metallic material, and the arc-extinguishing gas is suppressed.

By arranging the insulation nozzle 23 so as to circulate around the trigger electrode 31, and the decrease in the spraying velocity of the arc-extinguishing gas due to the pressure decrease at the time of spraying to the arc can be reduced.

It is preferable that a clearance distance between the insulation nozzle 23 and the trigger electrode 31 is larger than the clearance distance between the arc contactor (on the movable side) 41 and the trigger electrode 31. When the insulation nozzle 23 and the trigger electrode 31 contacts with each other, a triple junction portion with a high electric field is created and considerable degradation of the electrical performance occurs.

The trigger electrode 31 is longer in the axial direction and has a smaller diameter than other movable parts. Therefore, when driven at a high speed during circuit operation, there is a possibility of swing from the central axis due to vibration. Further, the trigger electrode 31 is not always located exactly on the central axis due to defective assembly or defective parts.

However, the guide portion 41*b* of the arc contactor (on a movable side) 41 guides the movement of the trigger electrode 31, and secures a constant separation distance between the trigger electrode 31 and the insulating nozzle 23 and between the trigger electrode 31 and the contact end 41*c* of the arc contactor (on the movable side) 41.

In the conventional technique, there are many cases where the insulation nozzle 23 is provided in the movable contactor portion 3 together with the movable conductive contactor 32. However, it is preferable that the movable contactor portion 3 is reduced in weight to be movable. Accordingly, it is preferable that the insulation nozzle 23 is provided in the fixed contactor portion 2 that does not move. Note that the insulation nozzle 23 may be provided in the movable contactor portion 3.

The insulation nozzle 23 may be provided either in the fixed contactor portion 2 or the movable contactor portion 3, but the movable contactor portion 3 vibrates and receives an impact due to movement. Accordingly, electrical performance deterioration due to vibration and breakage of the insulation nozzle 23 due to mechanical impact can be suppressed in the case where the insulation nozzle 23 is provided in the fixed contactor portion 2 compared with the case where the insulation nozzle 23 is provided in the movable contactor portion 3.

Since the insulation nozzle 23 can suppress the flow of the arc-extinguishing gas with low insulation performance and a high temperature into the fixed conductive contactor 22, it is preferable that the insulation nozzle 23 is provided in the fixed contactor portion 2. It is preferable that a clearance distance between the insulation nozzle 23 and the trigger electrode 31 is larger than the clearance distance between the arc contactor (on the movable side) 41 and the trigger electrode 31 during contact therebetween. When the insulation nozzle 23 and the trigger electrode 31 contacts with each other, a high electric field portion is created and considerable degradation of the electrical performance occurs. With the configuration described above, the maximum positional displacement width of the trigger electrode 31 from the center axis can be restricted by the inner diameter of the arc contactor (on the movable side) 41, preventing contact between the trigger electrode 31 and the insulation nozzle 23. In addition, an amount of leakage of the arc-extinguishing gas from the accumulation chamber 38 can be suppressed by limiting the clearance distance between the arc contactor (on the movable side) 41 and the trigger electrode 31.

When spraying the arc-extinguishing gas to the arc generated between the arc contactor (on the movable side) 41 and the arc contactor (on the fixed side) 21, it is preferable that the insulation nozzle 23 has a lower internal pressure. Accordingly, it is preferable that the insulation nozzle 23 has a shape such that a cross sectional area of the arc-extinguishing gas flow passage formed by the arc contactor (on the fixed side) 21 and the insulation nozzle 23 gradually increases toward the open-end direction.

According to the test results, in order to obtain good breaking performance, it is preferable to have the following flow passage configuration.

Area of the flow passage formed between the arc contactor (on the fixed side) 21 and the insulation nozzle 23>Area of the flow passage of the throat portion 23*a* of the insulation nozzle 23≥Area of the spray portion of the arc contactor (on the movable side) 41

Furthermore, it has been found that area of the flow passage formed between the arc contactor (on the movable side) 41 and the insulation nozzle 23 has an appropriate value between 20% and 200% of the area of the spray portion of the arc contactor (movable side) 41. With this configuration, the arc cooling performance in the vicinity of the arc-extinguishing gas spray outlet of the arc contactor (on the movable side) 41 is maximized, and a gas flow of the arc-extinguishing gas can be supplied from the throat portion 23*a* of the insulation nozzle 23 toward the open-end direction in a necessary and sufficient manner.

The insulation nozzle 23 controls the arc-extinguishing gas sprayed through the compression chamber 36 and the accumulation chamber 38 to efficiently cool the arc. Since the pressure inside the insulation nozzle 23 becomes a downstream pressure when the arc-extinguishing gas is sprayed, it is preferable to provide a structure such that the insulation nozzle 23 is always maintained at a low pressure.

The insulation nozzle 23 not only creates the arc-extinguishing gas flow parallel to the axis from the driving-device direction side to the open-end direction side, but also creates the arc-extinguishing gas flow in a direction crossing the arc. The arc is efficiently cooled by this flow. Since the arc-extinguishing gas that has become a high temperature by being sprayed to the arc has low insulation performance, it is preferable that the arc-extinguishing gas is exhausted without contacting the fixed conductive contactor 22 and the movable conductive contactor 32.

The arc generated in the arc space between the arc contactor (on the fixed side) 21 and the arc contactor (on the movable side) 41 becomes very high temperature. The arc-extinguishing gas that has been sprayed to the arc and become a high temperature is exhausted into the sealed container 8 through the exhaust ports 24*a*, 24*b*, and 24*c* of the exhaust cylinder 24.

The arc between the arc contactor (on the fixed side) 21 and the arc contactor (on the movable side) 41 is reduced in size at a current zero cross point of an alternating current supplied from the lead-out conductors 7*a* and 7*b*, and is extinguished by spraying the arc-extinguishing gas. As a result, the gas circuit breaker 1 becomes the opened state, and the current flowing in the lead-out conductors 7*a* and 7*b* are broken.

1-4. Effect (1) According to the present embodiment, since the gas circuit breaker 1 includes a bar-shaped trigger electrode 31 movably arranged between a first arc contactor 21 and a second arc contactor 41, and moving in the cylindrical second arc contactor 41 during the latter half of the current breaking action to ignite the arc to the second arc contactor 41, and a guide portion 41*b* having an inner diameter larger than an outer diameter of the trigger electrode 31, and smaller than an inner diameter of a portion of the second arc contactor which is close to the trigger electrode 31, and arranged in a cylinder of the second arc contactor 41 so as to circulate around the trigger electrode 31 when the trigger electrode 31 is in the closed state with the first arc contactor 21, it is possible to provide the gas circuit breaker that can suppress the mechanical vibration during the movement of the trigger electrode 31, reduce the generation of the triple junction during operation of the gas circuit breaker, and the generation of the metal foreign materials, and can maintain the electrical insulation performance more reliably.

The guide portion 41*b* of the arc contactor (on a movable side) 41 guides the movement of the trigger electrode during the current breaking action, and prevents the trigger electrode 31 from approaching the insulation nozzle 23. Therefore, the generation of the triple junction due to the insulation nozzle 23 made of an insulating material, the trigger electrode 31 made of a metallic material, and the arc-extinguishing gas can be suppressed.

(2) According to the present embodiment, the guide portion 41*b* of the arc contactor (on a movable side) 41 has an inner diameter larger than an outer diameter of the trigger electrode 31, and smaller than an inner diameter of the contact end 41*c* portion of the arc contactor (on a movable side) 41 which is close to the trigger electrode 31. The guide portion 41*b* suppresses the mechanical vibration during the movement of the trigger electrode 31.

Therefore, it is possible to prevent the trigger electrode 31 and the contact end 41*c* of the arc contactor (on the movable side) 41 from approaching and separating from each other. As a result, the current of the trigger electrode 31 can be reduced from being shunted to the contact end 41*c* of the arc contactor (on the movable side) 41 due to the discharge, and the formation of the concave portion due to the discharge mark can be suppressed.

When a concave portion is formed on the contact end 41*c* of the arc contactor (on the movable side) 41 due to the discharge mark, the arc-extinguishing gas leaks from this concave portion and the pressure decreases, and the velocity of the arc-extinguishing gas sprayed to the arc may decrease.

However, since the guide portion 41*b* of the arc contactor (on a movable side) 41 guides the movement of the trigger electrode 31, and the discharge from the trigger electrode 31 to the contact end 41*c* of the arc contactor (on the movable side) 41 is suppressed, the leakage of the arc-extinguishing gas from the concave portion due to the discharge mark can be suppressed, and the velocity of the arc-extinguishing gas sprayed to the arc can be secured.

(3) According the present embodiment, the guide portion 41*b* of the arc contactor (on the movable side) 41 guides the movement of the trigger electrode 31, and suppresses the trigger electrode 31 from contacting or sliding the contact end 41*c* of the arc contactor (on the movable side) 41. Therefore, the generation of fine metal foreign materials (so-called swarf) due to the trigger electrode 31 and the contact end 41*c* of the arc contactor (on the movable side) 41 being shaved can be reduced.

When the generated metal foreign materials are present in the high electric field portion, the electric insulation performance of the gas circuit breaker 1 may be threatened. However, it is possible to reduce the risk that the metal surfaces of the contact end 41*c* of the trigger electrode 31 and the arc contactor (on the movable side) 41 come into contact with each other during driving, and fine metal foreign materials are generated. Since the deterioration of the electric insulation performance of the gas circuit breaker due to the fine metal foreign materials is suppressed, the electric insulation performance of the gas circuit breaker 1 can be more reliably maintained.

(4) According to the present embodiment, the guide portion 41*b* is arranged in the cylinder of the conductive portion 41*a* of the arc contactor (on the movable side) 41 so as to be separated from an end in the open-end direction (arc-contactor-(on the fixed side)-21 side) of the arc contactor (on the movable side) 41 by at least the distance L obtained by multiplying the inner diameter DD of the contact end 41*c* of the arc contactor (on a movable side) 41 by 0.2. This reduces the electric field strength at the contact portion between the guide portion 41*b* and the trigger electrode 31, and the generation of the triple junction due to the guide portion 41*b* made of an insulating material, the trigger electrode 31 made of a metallic material, and the arc-extinguishing gas is suppressed, and the electric insulation performance of the gas circuit breaker 1 is maintained.

(5) According to the present embodiment, since the inner diameter of the guide portion 41*b* of the arc contactor (on a movable side) 41 has a taper portion 41*d* that increases toward the drive device direction, and forms a truncated cone-shaped space inside the arc contactor (on the movable side) 41, the taper portion 41*d* of the guide portion 41*b* can smoothly guides the arc-extinguishing gas from inside the arc contactor (on the movable side) 41 toward the insulation nozzle 23 during the current breaking action.

(5) According to the present embodiment, since the guide portion 41*b* of the arc contactor (on a movable side) 41 is made of at least one of insulating materials among acrylic, polycarbonate, polystyrene, polyethylene, polypropylene, polyolefin, and PTFE, it is possible to prevent the trigger electrode 31 from being shaved by the contact end 41*c* of the arc contactor (on the movable side) 41 due to the movement during the current breaking action.

2. Other Embodiments

Although the embodiment that includes the modified example thereof has been described, such embodiment is merely presented as an example, and is not intended to limit the scope of the present embodiment. Such embodiments can be implemented in other various forms, and various omissions, replacements, and modifications can be made without departing from the scope of the present embodiment. Such embodiment and the modified form thereof are within the scope of the present embodiment and also within the scope of the invention as recited in the appended claims and the equivalent range thereto. The followings are examples thereof.

In the above-described embodiment, the fixed contactor portion 2 and the fixed contactor portion 4 are fixed to the sealed container 8, but the fixed contactor portion 2 and the fixed contactor portion 4 may be movable. When the gas circuit breaker 1 becomes the opened state, for example, the fixed contactor portion 2 may be movable in the open-end direction. In addition, the fixed contactor portion 4 may be movable in the driving-device direction. When the fixed contactor portion 2 or 4 or the fixed contactor portion 2 and 4 are movable, the power between the lead-out conductors 7*a* and 7*b* can be broken more quickly.

Figure 6A:
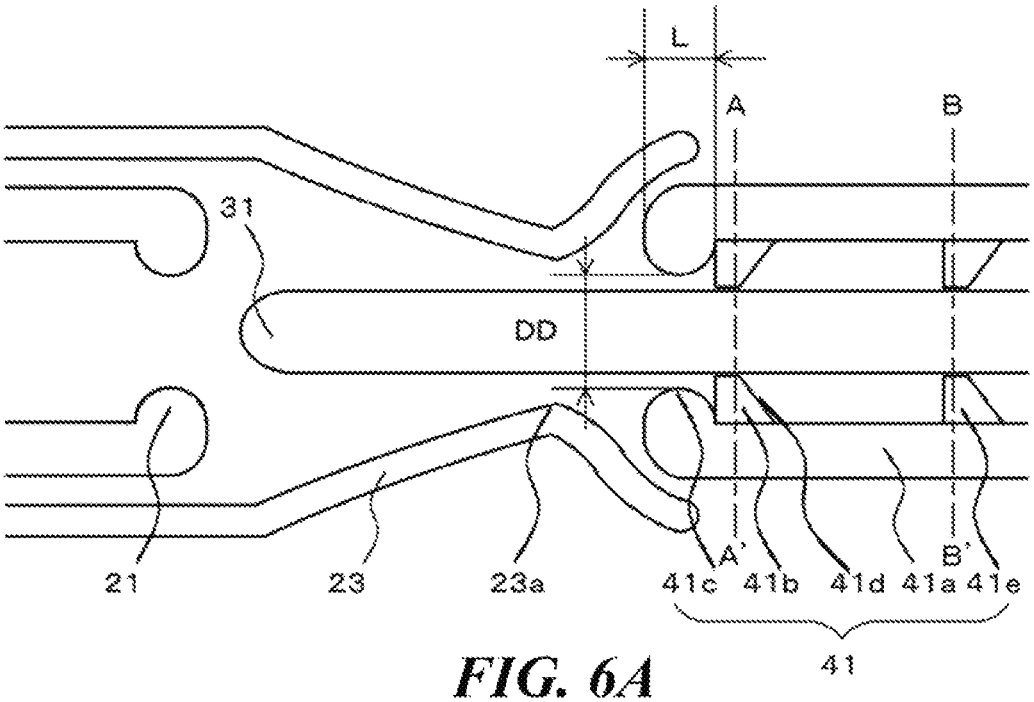
FIG. 6 is an enlarged view illustrating a positional relation between the arc contoctor (on the movable side) and the guide portion against the trigger electrode of the gas circuit breaker according to the other embodiment.

In the above-described embodiment, the guide portion 41*b* is provided at one location of the arc contactor (on the movable side) 41, however, as shown in FIG. 6A, a plurality of guide portions 41*b* and guide portions 41*e* may be provided at a plurality of locations of the arc contactor (on the movable side) 41. In this way, by providing the plurality of the guide portions 41*b* and the guide portion 41*e* at a plurality of locations on the arc contactor (on the movable side) 41, the mechanical vibration due to the movement of the trigger electrode 31 during the current breaking action can be further suppressed.

With this configuration, the plurality of the guide portions 41*b* and the guide portions 41*e* guides the movement of the trigger electrode 31 more accurately, and it is possible to prevent the trigger electrode 31 from contacting, sliding, or approaching and separating from the insulation nozzle 23 made of an insulating material and the contact end 41*c* of the arc contactor (on the movable side) 41 made of a metallic material.

This further allows to provide a gas circuit breaker 1 that can suppress the mechanical vibration during movement of the trigger electrode 31, reduce the generation of a triple junction during operation of the gas circuit breaker and the generation of the metal foreign materials, and maintain the electrical insulation performance more reliably. In addition, as a result, the current of the trigger electrode 31 can be reduced from being shunted to the contact end 41*c* of the arc contactor (on the movable side) 41 due to the discharge, and the formation of the concave portion due to the discharge mark can be suppressed. It is possible to provide the gas circuit breaker 1 that can further suppress the leakage of the arc-extinguishing gas from the concave portion due to the discharge mark, and further secure the velocity of the arc-extinguishing gas sprayed to the arc.

Figure 6B:
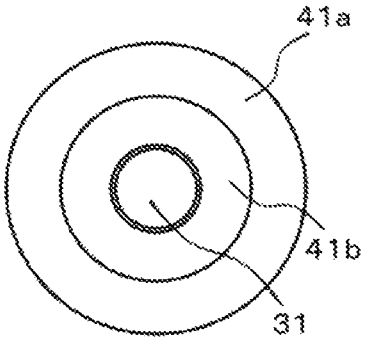
Figure 6C:
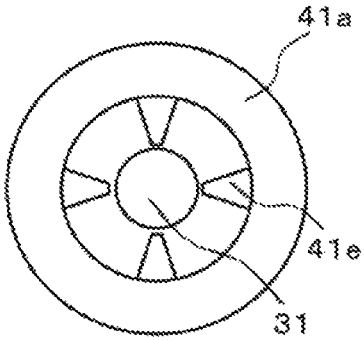

It is desirable that the guide portion 41*b* is formed by a torus-shaped member as shown in FIG. 6B, and the guide portion 41*e* is formed by a member having a plurality of radial shapes as shown in FIG. 6C. With this configuration, the guide portion 41*b* ensures the air-tightness of the arc-extinguishing gas, the guide portion 41*e* can be prevented from becoming an obstacle in the flow path of the arc-extinguishing gas, and the velocity of the arc-extinguishing gas sprayed to the arc can be secured.

In addition, both the plurality of the guide portions 41*b* and the guide portions 41*e* may be configured by members having a plurality of radial shapes. With this configuration, the plurality of the guide portions 41*b* and the guide portion 41*e* can be prevented from becoming an obstacle in the flow path of the arc-extinguishing gas, and the velocity of the arc-extinguishing gas sprayed to the arc can be secured.

REFERENCE SIGNS LIST

1 Gas circuit breaker
2, 4 Fixed contactor portion
3 Movable contactor portion
7*a*, 7*b* Lead-out conductor
8 Sealed container
9 Driving device
21 Arc contactor (on a fixed side)
22 Fixed conductive contactor
23 Insulation nozzle
23*a* Throat portion
24 Exhaust cylinder
24*a*, 24*b*, 24*c* Exhaust port
31 Trigger electrode
32 Movable conductive contactor
33 Piston
33*a* Piston support
36 Compression chamber
37 Insulation rod
38 Accumulation chamber
41 Arc contactor (on a movable side)
41*a* Conductive portion
41*b* Guide portion
41*c* Contact end
41*d* Taper portion
41*e* Guide portion
42 Cylinder
42*a* Insertion hole
42*b* Through hole
42*c* Intake hole
42*d* Air intake valve
42*e* Check valve
43 Support

The invention claimed is:

1. A gas circuit breaker, comprising:

a first arc contactor electrically connected to a first lead-out conductor connected to a power system;

a cylindrical second arc contactor electrically connected to a second lead-out conductor;

a bar-shaped trigger electrode arranged to be movable between the first arc contactor and the second arc contactor, an arc generated between the first arc contactor and the trigger electrode is ignited along with a movement in a first half of a current breaking action, and moves in the second arc contactor during a latter half of the current breaking action to commutates the arc to the second arc contactor; and a guide portion having an inner diameter larger than an outer diameter of the trigger electrode, and the inner diameter smaller than an inner diameter of a portion of the second arc contactor close to the trigger electrode, and arranged in a cylinder of the second arc contactor so as to circulate around the trigger electrode;

wherein the guide portion is arranged to be separated from an end in a first-arc-contactor side of the second arc contactor to an opposite side of the first arc contactor by at least a distance obtained by multiplying the inner diameter of the end of the second arc contactor which is close to the trigger electrode by 0.2.

2. The gas circuit breaker according to claim 1, wherein the inner diameter of the guide portion has a taper portion that increases toward the opposite side of the first arc contactor, and forms a truncated cone-shaped space inside the second arc contactor.

3. The gas circuit breaker according to claim 1, wherein the guide portion is made of at least one of insulating materials among acrylic, polycarbonate, polystyrene, polyethylene, polypropylene, polyolefin, and PTFE.

4. A gas circuit breaker, comprising:

a first arc contactor electrically connected to a first lead-out conductor connected to a power system;

a cylindrical second arc contactor electrically connected to a second lead-out conductor;

a bar-shaped trigger electrode arranged to be movable between the first arc contactor and the second arc contactor, an arc generated between the first arc contactor and the trigger electrode is ignited along with a movement in a first half of a current breaking action, and moves in the second arc contactor during a latter half of the current breaking action to commutates the arc to the second arc contactor; and a guide portion having an inner diameter larger than an outer diameter of the trigger electrode, and the inner diameter smaller than an inner diameter of a portion of the second arc contactor close to the trigger electrode, and arranged in a cylinder of the second arc contactor so as to circulate around the trigger electrode;

wherein the guide portion is arranged to be separated from an end in a first-arc-contactor side of the second arc contactor to an opposite side of the first arc contactor by at least a distance obtained by multiplying the inner diameter of the end of the second arc contactor which is close to the trigger electrode by 0.2, and arranged in the cylinder of the second arc contactor so as to circulate around the trigger electrode when the trigger electrode is in a closed state with the first arc contactor.

5. The gas circuit breaker according to claim 4, wherein the inner diameter of the guide portion has a taper portion that increases toward the opposite side of the first arc contactor, and forms a truncated cone-shaped space inside the second arc contactor.

6. The gas circuit breaker according to claim 4, wherein the guide portion is made of at least one of insulating materials among acrylic, polycarbonate, polystyrene, polyethylene, polypropylene, polyolefin, and PTFE.

* * * * *